US006657396B2

(12) United States Patent
Nakada et al.

(10) Patent No.: US 6,657,396 B2
(45) Date of Patent: Dec. 2, 2003

(54) ALTERNATING CURRENT DRIVEN TYPE PLASMA DISPLAY DEVICE AND METHOD FOR PRODUCTION THEREOF

(75) Inventors: Satoshi Nakada, Kanagawa (JP); Ichiro Utsumi, Tokyo (JP); Hiroshi Mori, Kanagawa (JP); Eitaro Yoshikawa, Kanagawa (JP); Tomohiro Kimura, Tokyo (JP); Kazunao Oniki, Tokyo (JP); Shinichiro Shirozu, Tokyo (JP)

(73) Assignee: Sony Corporation (JP)

( * ) Notice: Subject to any disclaimer, the term of this patent is extended or adjusted under 35 U.S.C. 154(b) by 116 days.

(21) Appl. No.: 09/755,167

(22) Filed: Jan. 8, 2001

(65) Prior Publication Data

US 2001/0048275 A1 Dec. 6, 2001

(30) Foreign Application Priority Data

Jan. 11, 2000 (JP) ..... P2000-002532
Jul. 10, 2000 (JP) ..... P2000-208720
Jul. 24, 2000 (JP) ..... P2000-222007

(51) Int. Cl.[7] ..... G09G 3/10

(52) U.S. Cl. ..... 315/169.1; 315/169.3; 313/584

(58) Field of Search ..... 315/169.1, 169.3, 315/169.4; 313/584, 586, 587, 489, 585, 590; 445/24

(56) References Cited

U.S. PATENT DOCUMENTS 5,791,960 A * 8/1998 Fukuta et al. ..... 445/24
6,034,474 A * 3/2000 Ueoka et al. ..... 313/584
6,218,784 B1 * 4/2001 Jang et al. ..... 315/169.1
6,407,509 B1 * 6/2002 Ikeda et al. ..... 315/169.4
6,437,507 B2 * 8/2002 Ha ..... 313/587
6,522,081 B1 * 2/2003 Oversluizen et al. .... 315/169.4

FOREIGN PATENT DOCUMENTS

EP 0938123 A2 8/1999
EP 0957502 A2 11/1999
JP 08-162027 6/1996
JP 10-021836 1/1998

* cited by examiner

*Primary Examiner*—Don Wong
*Assistant Examiner*—Jimmy F. Vu
(74) *Attorney, Agent, or Firm*—Rader, Fishman & Grauer PLLC; Ronald P. Kananen

(57) ABSTRACT

An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a thickness of $1.5\times10^{-5}$ m or less.

71 Claims, 23 Drawing Sheets

RELATIONSHIP BETWEEN THICKNESS OF DIELECTRIC MATERIAL LAYER AND BRIGHTNESS

RELATIONSHIP BETWEEN THICKNESS OF
DIELECTRIC MATERIAL LAYER AND DISCHARGE VOLTAGE

RELATIONSHIP BETWEEN DISTANCE BETWEEN SUSTAIN ELECTRODES AND BRIGHTNESS

THICKNESS OF FIRST DIELECTRIC MATERIAL FILM : 3μm

RELATIONSHIP BETWEEN DISTANCE BETWEEN SUSTAIN ELECTRODES AND BRIGHTNESS

THICKNESS OF FIRST DIELECTRIC MATERIAL FILM : 10μm

ALTERNATING CURRENT DRIVEN TYPE PLASMA DISPLAY DEVICE AND METHOD FOR PRODUCTION THEREOF

BACKGROUND OF THE INVENTION AND RELATED ART STATEMENT

The present invention relates to an alternating current driven type plasma display device having a characteristic feature in a dielectric material layer and a method for the production thereof.

As an image display device that can be substituted for a currently mainstream cathode ray tube (CRT), flat-screen (flat-panel) display devices are studied in various ways. Such fat-panel display devices include a liquid crystal display (LCD), an electroluminescence display (ELD) and a plasma display device (PDP). Of these, the plasma display device has advantages that it is relatively easy to form a larger screen and attain a wider viewing angle, that it has excellent durability against environmental factors such as temperatures, magnetism, vibrations, etc., and that it has a long lifetime. The plasma display device is therefore expected to be applicable not only to a home-use wall-hung television set but also to a large-sized public information terminal.

In the plasma display device, a voltage is applied to discharge cells having discharge spaces charged with a discharge gas composed of a rare gas, and a fluorescence layer in each discharge cell is excited with ultraviolet ray generated by glow discharge in the discharge gas, to give light emission. That is, each discharge cell is driven according to a principle similar to that of a fluorescent lamp, and generally, the discharge cells are put together on the order of hundreds of thousands to constitute a display screen. The plasma display device is largely classified either as a direct-current driven type (DC type) or an alternating current driven type (to be abbreviated as "AC type" hereinafter) according to methods of applying a voltage to the discharge cells. Each type has advantages and disadvantages. The AC plasma display device is suitable for attaining a higher fineness, since separation walls which work to separate the individual discharge cells within a display screen can be formed, for example, in the form of stripes. Further, it has an advantage that electrodes for discharge are less worn out and have a long lifetime since surfaces of the electrodes are covered with a dielectric material layer.

FIG. 7 shows an exploded perspective of part of a typical constitution of an AC plasma display device. This AC plasma display device comes under a so-called tri-electrode type, and glow discharge takes place mainly between a pair of sustain electrodes 12A and 12B. In the AC plasma display device shown in FIG. 7, a first panel (front panel) 10 and a second panel (rear panel) 20 are bonded to each other in their circumferential portions. Light emission from fluorescence layers 24 in the second panel 20 is viewed through the first panel 10.

The first panel 10 comprises a transparent first substrate 11; pairs of the sustain electrodes (first sustain electrodes 12A and second sustain electrodes 12B) composed of a transparent electrically conductive material and formed on the first substrate 11 in the form of stripes; bus electrodes (first bus electrodes 13A and second bus electrodes 13B) composed of a material having a lower electric resistivity than the sustain electrodes 12A and 12B and provided for decreasing the impedance of the sustain electrodes 12A and 12B; a dielectric material layer 14 formed on the first substrate 11, the sustain electrodes 12A and 12B and the bus electrodes 13A and 13B; and a protective layer 115 formed on the dielectric material layer 14. Generally, the dielectric material layer 14 is composed, for example, of a calcined product of a low-melting glass paste, and the protective layer 115 is composed of magnesium oxide (MgO).

The second panel 20 comprises a second substrate 21; second electrodes (also called address electrodes or data electrodes) 22 formed on the second substrate 21 in the form of stripes; a dielectric substance layer 23 formed on the second substrate 21 and the second electrodes 22; insulating separation walls 25 which are formed in regions on the dielectric substance layer 23 and between neighboring second electrodes 22 and which extend in parallel with the second electrodes 22; and fluorescence layers 24 which are formed on, and extend from, upper surfaces of the dielectric substance layer 23 and which are also formed on side walls of the separation walls 25. Each fluorescence layer 24 is constituted of a red fluorescence layer 24R, a green fluorescence layer 24G and a blue fluorescence layer 24B, and the fluorescence layers 24R, 24G and 24B of these colors are formed in a predetermined order. FIG. 7 is an exploded perspective view, and in an actual embodiment, top portions of the separation walls 25 on the second panel side are in contact with the protective layer 115 on the first panel side. A region where a pair of the sustain electrodes 12A and 12B and the second electrode 22 positioned between two separation walls 25 overlap corresponds to a discharge cell. A rare gas is sealed in each space surrounded by neighboring two separation walls 25, the fluorescence layer 24 and the protective layer 115. The first panel 10 and the second panel 20 are bonded to each other in their circumferential portions.

The extending direction of projection image of the bus electrodes 13A and 13B and the extending direction of projection image of the second electrodes 22 make an angle of 90°, and a region where a pair of the sustain electrodes 12A and 12B and one set of the fluorescence layers 24R, 24G and 24B for emitting light of three primary colors overlap corresponds to one pixel. Since glow discharge takes place between a pair of the sustain electrodes 12A and 12B, a plasma display device of this type is called "surface discharge type". In each discharge cell, the fluorescence layer excited by irradiation with vacuum ultraviolet ray generated by glow discharge in the rare gas emits light of colors characteristic of kinds of fluorescence materials. Vacuum ultraviolet ray having a wavelength depending upon the kind of the sealed rare gas is generated.

FIG. 6 shows a layout of the sustain electrodes 12A and 12B, the bus electrodes 13A and 13B and the separation walls 25 in the plasma display device shown in FIG. 7. A region surrounded by dotted lines corresponds to one pixel. For clearly showing each component, slanting lines are added to FIG. 6. One pixel generally has the form of a square. One pixel is divided into three sections (discharge cells) with the separation walls 25, and light in one of three primary colors (R, G, B) is emitted from one section. FIG. 23 shows a schematic partial end view of the first panel 10 having the above structure when the first panel 10 is cut along an arrow B—B in FIG. 6.

FIG. 14 schematically shows a variant in which the layout of the sustain electrodes 12A and 12B, the bus electrodes 13A and 13B and the separation walls 25 in the plasma display device is varied. JP-A-9-167565 discloses this variant, which has a structure in which the sustain electrodes 12A and 12B extend from a pair of the bus electrodes 13A and 13B toward the bus electrodes 13B and 13A. When cut in the same direction as the direction of the arrow B—B in FIG. 6, the first panel 10 having the above structure gives a schematic partial end view as shown in FIG. 23.

Generally, the discharge gas charged in the discharge space consists of a gas mixture of an inert gas such as a neon (Ne) gas, a helium (He) gas or an argon (Ar) gas with approximately 4% by volume of a xenon (Xe) gas, and the gas mixture has a total pressure of approximately $6\times10^4$ Pa to $7\times10^4$ Pa, and the xenon (Xe) gas has a partial pressure of approximately $3\times10^3$ Pa. Further, a pair of the sustain electrodes 12A and 12B has a distance of approximately 100 $\mu$m from each other.

The problem with presently commercialized AC plasma display devices is that that the brightness thereof is low. For example, a 42-inch type AC plasma display device has brightness of approximately 500 cd/m$^2$ at the highest. For practically commercializing an AC plasma display device, further, it is required, for example, to attach a sheet or a film as a shield against electromagnetic waves or external light to the outer surface of the first panel 10, and the AC plasma display device tends to be considerably dark on an actual screen.

The first panel 10 of the AC plasma display device has, for example, the dielectric material layer 14 composed of a dielectric material such as a low-melting glass paste. The dielectric material layer 14 is generally formed by a screen printing method. When the AC plasma display device is driven, the dielectric material layer 14 is allowed to accumulate a charge, and an opposite–directional voltage is applied to the sustain electrodes to discharge the accumulated charge, whereby plasma is generated. The brightness depends upon the quantity of vacuum ultraviolet ray generated from the plasma. For improving the brightness, therefore, it is required to allow the dielectric material layer 14 to accumulate a charge as high as possible.

Further, the AC plasma display device is increasingly demanded to satisfy a higher density of pixels, a higher fineness and drivability at a lower voltage. For attaining a higher density of pixels and drivability at a lower voltage, it is required to decrease the distance (discharge gap) between a pair of the sustain electrodes 12A and 12B. If the discharge gap is decreased, it is inevitably required to decrease the thickness of the dielectric material layer 14. That is, when the dielectric material layer 14 has a large thickness relative to the discharge gap, most electric lines of flux pass through the dielectric material layer 14, and as a result, glow discharge does not easily take place in the space above the discharge gap.

Meanwhile, if the thickness of the dielectric material layer 14 is decreased, naturally, the voltage resistance decreases. Further, the thickness of the bus electrodes 13A and 13B is greater than the thickness of the sustain electrodes 12A and 12B, and the distance from the top surface of the bus electrodes 13A and 13B to the top surface of the second electrodes 22 is smaller than the distance from the top surface of the sustain electrodes 12A and 12B to the second electrodes 22. Therefore, if the thickness of the dielectric material layer 14 is decreased, therefore, abnormal discharge is liable to take place between the top surface edge portion of the bus electrode 13A or 13B and the second electrode 22, and in a worst case, the bus electrodes 13A or 13B is damaged.

OBJECT AND SUMMARY OF THE INVENTION

It is therefore a first object of the present invention to provide an alternating current driven type plasma display device structured to increase a charge accumulation amount for improving the brightness, and a method for the production thereof.

It is a second object of the present invention to provide an alternating current driven type plasma display device having a structure in which the abnormal discharge does not easily take place between the bus electrode and the second electrodes as an address electrode even when the discharge gap between a pair of the sustain electrodes and the thickness of the dielectric material layer are decreased for satisfying demands for a higher density of pixels and drivability at a lower voltage, and a method for the production thereof.

The alternating current driven type plasma display device (to be abbreviated as "plasma display device" in some cases, hereinafter) according to a first aspect of the present invention for achieving the above first object is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a thickness of $1.5\times10^{-5}$ m or less, preferably $1.0\times10^{-5}$ m or less.

In the plasma display device according to the first aspect of the present invention, desirably, the lower limit of the dielectric material layer is, for example, $5\times10^{-7}$ m, and preferably $1\times10^{-6}$ m. The dielectric material layer may have a single-layered structure or may have a multi-layered structure.

In the plasma display device according to the first aspect of the present invention, since the dielectric material layer has a sufficiently small thickness as compared with a dielectric material layer (generally, approximately $2.5\times10^{-5}$ m thick) in a conventional AC plasma display device, the capacitance of the dielectric material layer can be increased. As a result, the driving voltage can be decreased, and the charge accumulation amount can be increased, so that the plasma display device can be improved in brightness and that the driving power can be decreased.

The plasma display device according to a second aspect of the present invention for achieving the above first object is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of an aluminum oxide layer.

The dielectric material layer of the plasma display device according to the second aspect of the present invention may have a two-layered structure comprising a first dielectric material film constituted of an aluminum oxide layer and a second dielectric material film formed on the first dielectric material film or may have a single-layered structure constituted of an aluminum oxide layer. The material constituting the second dielectric material film includes magnesium oxide (MgO), magnesium fluoride ($MgF_2$) and calcium fluoride ($CaF_2$). Of these, magnesium oxide is a suitable material having properties such as a high emission ratio of secondary electrons, a low sputtering ratio, a high transmissivity to light at a wavelength of light emitted from the fluorescence layers and a low discharge initiating voltage. The second dielectric material film may have a stacked structure composed, at least, of two materials selected from the group consisting of these materials. Second dielectric material films in various alternating current driven type plasma display devices of the present invention to be explained hereinafter can be also composed of the above materials.

The plasma display device according to a third aspect of the present invention for achieving the above first object of the present invention is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a stacked structure constituted, at least, of an aluminum oxide layer and a silicon oxide layer.

In the plasma display device according to the third aspect of the present invention, the stacked structure may be constituted of an aluminum oxide layer and a silicon oxide layer stacked in this order from a bottom, may be constituted of a silicon oxide layer and an aluminum oxide layer stacked in this order from a bottom, or may be constituted of plurality of aluminum oxide layers and silicon oxide layers stacked alternately. In this case, the number of stacked layers may be an even number or may be an odd number. Further, the dielectric material layer may have a multi-layered structure comprising a first dielectric material film constituted of an aluminum oxide layer and a silicon oxide layer and a second dielectric material film formed on the first dielectric material film. When the dielectric material layer has a stacked structure constituted of an aluminum oxide layer and a silicon oxide layer, a stress in the dielectric material layer can be decreased, and cracking of the dielectric material layer can be prevented.

The plasma display device according to a fourth aspect of the present invention for achieving the first object of the present invention is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of a silicon oxide layer.

In the plasma display device according to the fourth aspect of the present invention, the dielectric material layer may also have a two-layered structure comprising a first dielectric material film constituted of a silicon oxide layer and a second dielectric material film formed on the first dielectric material film.

The plasma display device according to a fifth aspect of the present invention for achieving the first object of the present invention is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of a diamond-like carbon layer, a boron nitride layer or a chromium (III) oxide layer.

In the plasma display device according to the fifth aspect of the present invention, the dielectric material layer may also have a two-layered structure comprising a first dielectric material film constituted of a diamond-like carbon layer, a boron nitride layer or a chromium (III) oxide layer and a second dielectric material film formed on the first dielectric material film.

The plasma display device according to a sixth aspect of the present invention for achieving the first object of the present invention is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a stacked structure constituted, at least, a layer composed of diamond-like carbon, boron nitride or chromium (III) oxide and a layer composed of silicon oxide or aluminum oxide.

In the plasma display device according to the sixth aspect of the present invention, the structure of the dielectric material layer includes a two-layered structure of layer "A" and layer "B" from a bottom, a three-layered structure of layer "A", layer "B" and layer "A" from a bottom and a multi-layered structure of layer "A", layer "B", layer "A", layer "B" . . . from a bottom. When the above layer "A" is a diamond-like carbon layer, a boron nitride layer or a chromium (III) oxide layer, the layer "B" is a silicon oxide or aluminum oxide layer or is a layer having a stacked structure of a silicon oxide layer and an aluminum oxide layer. When two or more layers "A" are employed, the layers "A" may be composed of one material or different materials, and when two or more layers "B" are employed, the layers "B" may be composed of one material or different materials. When the layer "A" is a silicon oxide or aluminum oxide layer or is a layer having a stacked structure of a silicon oxide layer and an aluminum oxide layer, the layer "B" is a diamond-like carbon layer, a boron nitride layer or a chromium (III) oxide layer. In this case, when two or more layers "A" are employed, the layers "A" may be composed of one material or different materials, and when two or more layers "B" are employed, the layers "B" may be composed of one material or different materials. When the above silicon oxide or aluminum oxide layer or the above layer having a stacked structure of a silicon oxide layer and an aluminum oxide layer is used as an element for constituting the dielectric material layer, the stress in the dielectric material layer can be decreased, and the cracking of the dielectric material layer can be prevented.

In the plasma display device according to the sixth aspect of the present invention, the dielectric material layer may also have a multi-layered structure comprising a first dielectric material film constituted of the above stacked structure and a second dielectric material film formed on the first dielectric material film.

The plasma display device according to a seventh aspect of the present invention for achieving the first object of the present invention is an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of two layers selected from the group consisting of a diamond-like carbon layer, a boron nitride layer and a chromium (III) oxide layer.

In the plasma display device according to the seventh aspect of the present invention, the structure of the dielectric material layer includes a two-layered structure of layer "A" and layer "B" from a bottom, a three-layered structure of layer "A", layer "B" and layer "C" from a bottom and a multi-layered structure of layer "A", layer "B", layer "C", layer "D" . . . from a bottom. The above diamond-like carbon layer, the above boron nitride layer and the above chromium (III) oxide layer will be referred to as "material layer" for the convenience. Materials constituting neighboring material layers (for example, layer "A" and layer "B") are different from each other. Materials constituting non-neighboring material layers (for example, layer "A" and layer "C") may be different from each other or may be the same as each other.

In the plasma display device according to the seventh aspect of the present invention, the dielectric material layer may further have a silicon oxide layer or an aluminum oxide layer or may further have a stacked structure of a silicon oxide layer and an aluminum oxide layer. In the above embodiment, when the dielectric material layer further has, for example, a silicon oxide layer, the structure of the dielectric material layer includes a three-layered structure of a silicon oxide layer, layer "A" and layer "B" from a bottom, a three layered structure of layer "A", a silicon oxide layer and layer "B" and a three-layered structure of layer "A", layer "B" and a silicon oxide layer. In the three-layered structure of layer "A", layer "B" and layer "C" or the multi-layered structure of layer "A", layer "B", layer "C", layer "D" . . . , at least one silicon oxide layer can be interposed between any two material layers or can be placed as a topmost material layer or a bottommost material layer. When a silicon oxide layer, an aluminum oxide layer or a stacked structure of a silicon oxide layer and an aluminum oxide layer is used as an element for constituting the dielectric material layer as described above, the stress in the dielectric material layer can be decreased, and the cracking of the dielectric material layer can be prevented.

In the plasma display device according to the seventh aspect of the present invention, the dielectric material layer may have a multi-layered structure comprising a first dielectric material film constituted of the above stacked structure and a second dielectric material film formed on the first dielectric material film.

In the plasma display device according to any one of the second to seventh aspects of the present invention, desirably, the thickness of the dielectric material layer is $1.5\times10^{-5}$ m or less, preferably $1.0\times10^{-5}$ m or less. Desirably, the lower limit of the thickness of the dielectric material layer is, for example, $5\times10^{-7}$ m, preferably $1\times10^{-6}$ m. When the dielectric material layer comprises the first dielectric material film and the second dielectric material film, the thickness of the dielectric material layer is a total thickness of the first dielectric material film and the second dielectric material film. When the dielectric material layer comprises the first dielectric material film and the second dielectric material film, the thickness of the second dielectric material film is preferably $1\times10^{-6}$ m to $1\times10^{-5}$ m. When the thickness of the dielectric material layer is defined as described above, the capacitance of the dielectric material layer can be increased. As a result, the driving voltage can be decreased, and the charge accumulation amount can be increased, so that the brightness of the plasma display device can be improved and the driving power thereof can be decreased.

In the plasma display device according to any one of the first to seventh aspects of the present invention, the sustain electrodes formed in the first panel can be constituted to work as a pair. The distance between the sustain electrodes constituting each pair is essentially any distance so long as the glow discharge required takes place at a predetermined discharge voltage. Desirably, the distance between a pair of the sustain electrodes is less than $5\times10^{-5}$ m, preferably less than $5.0\times10^{-5}$ m, and more preferably $2\times10^{-5}$ m or less. When the distance between a pair of the sustain electrodes is approximately $1\times10^{-4}$ m, and when the thickness of the dielectric material layer is too large, there are some cases where discharge breakdown takes place in the dielectric material layer and a charge is not easily accumulated in the dielectric material layer. In the plasma display device according to the first aspect of the present invention, since the dielectric material layer has a small thickness as compared with a conventional case, and in the plasma display device according to any one of the second to seventh aspects of the present invention, when the dielectric material layer has a small thickness as compared with a conventional case, that is, the thickness of the dielectric material layer is defined to be $1.5\times10^{-5}$ m or less, desirably, $1.0\times10^{-5}$ m or less, the above phenomenon can be reliably inhibited.

In the plasma display device according to any one of the second to seventh aspects of the present invention, the dielectric material layer is composed of a material having a relatively large specific dielectric constant (for example, an aluminum oxide layer formed by a sputtering method has a specific dielectric constant of 9 to 10), whereby the capacitance of the dielectric material layer can be increased. As a result, the charge accumulation amount can be increased, so that the plasma display device can be improved in brightness and the driving power thereof can be decreased.

In the plasma display device according to the present invention including an alternating current driven type plasma display device according to an eighth aspect of the present invention to be described later, since the dielectric material layer is formed, the direct contact of ions or electrons to the sustain electrodes can be prevented. As a result, wearing of the sustain electrodes can be prevented. The dielectric material layer not only works to accumulate a wall charge but also works as a resistance material to limit an excess discharge current and works as a memory to sustain a discharge state.

In the plasma display device according to any one of the first to seventh aspect of the present invention, there may be employed a constitution in which one of a pair of the sustain electrodes is formed in the first panel and the other is formed in the second panel. The thus-constituted plasma display device will be called "bi-electrode type" for convenience. In this case, the projection image of one sustain electrode extends in a first direction, the projection image of the other extends in a second direction different from the first direction, and a pair of the sustain electrodes are arranged such that one sustain electrode faces the other. Alternatively, there may be employed a constitution in which a pair of the sustain electrodes are formed in the first panel and a so-called address electrode (second electrode) is formed in the second panel. The thus-constituted plasma display device will be referred to as "tri-electrode type" for convenience. In this case, there may be employed a constitution in which the projection images of a pair of the sustain electrodes extend in a first direction in parallel with each other, the projection image of the address electrode (second electrode) extends in a second direction and a pair of the sustain electrodes and the address electrode (second electrode) are arranged such that a pair of the sustain electrodes face the address electrode, although the constitution shall not be limited thereto. In these cases, in view of the structural simplification of the plasma display device, preferably, the first direction and the second direction cross each other at right angles.

In the plasma display device according to any one of the first to seventh aspects of the present invention, the form of a gap between facing edge portions of a pair of the sustain electrodes formed in the first panel may be linear. Alternatively, the form of the above gap may have a pattern bent or curved in the width direction of the sustain electrodes. In this case, the area of portions of the sustain electrodes which portions contribute to discharging can be increased.

The plasma display device according to an eighth aspect of the present invention for achieving the above second object is an alternating current driven type plasma display device comprising;

(1) a first panel having a first substrate; a first electrode group consisting of a plurality of first electrodes formed on the first substrate; and a dielectric material layer which covers the first electrodes and is constituted of a first dielectric material layer and a second dielectric material layer, and (2) a second panel having a second substrate; a second electrode group consisting of a plurality of second electrodes extending while making a predetermined angle with the extending direction of the first electrodes, said second electrodes being formed on the second substrate; separation walls each of which is formed between one second electrode and another neighboring second electrode; and fluorescence layers formed on or above the second electrodes, wherein each first electrode comprises;

(A) a first bus electrode, (B) a first sustain electrode being in contact with the first bus electrode, (C) a second bus electrode extending in parallel with the first bus electrode, and (D) a second sustain electrode being in contact with the second bus electrode and facing the first sustain electrode, and wherein discharge takes place between the first sustain electrode and the second sustain electrode, said plasma display device characterized in that a first portion of the dielectric material layer which portion covers the first bus electrode and the second bus electrode comprises the first dielectric material layer and the second dielectric material layer, and a second portion of the dielectric material layer which covers the first sustain electrode and the second sustain electrode comprises the first dielectric material layer.

In the plasma display device according to the eighth aspect of the present invention or in a production method according to a third aspect of the present invention to be described later, since the first portion of the dielectric material layer which portion covers the first bus electrode and the second bus electrode comprises the first dielectric material layer and the second dielectric material layer, abnormal discharge, for example, between a top surface of the bus electrode and the second electrode can be reliably prevented. The dielectric material layer as a whole works to accumulate a wall charge, works as a resistance material to limit an excess discharge current and works as a memory to sustain a discharge state.

In the plasma display device according to the eighth aspect of the present invention, there may be employed a constitution in which the element constituting a first bus electrode and the element constituting a first electrode neighboring on said first bus electrode are independent of each other, or there may be employed a constitution in which a first bus electrode constituting a first electrode and a second bus electrode constituting a first electrode neighboring on said first electrode are in common (i.e., said first bus electrode and said second electrode are constituted of one conductive material layer, for example, in the form of a stripe). A plasma display device having the former constitution will be referred to as a plasma display device according to the first constitution, and a plasma display device having the latter constitution will be referred to as a plasma display device according to the second constitution. In the plasma display device according to the second constitution of the present invention, the first portion of the dielectric material layer which portion covers the first bus electrode constituting the first electrode and the first portion of the dielectric material layer which portion covers the second bus electrode constituting the first electrode neighboring on said first electrode are in common. "The plasma display device according to the eighth aspect of the present invention" to be described hereinafter includes the plasma display devices according to the first and second constitutions of the present invention. In the plasma display device according to the second constitution of the present invention, the first bus electrode and the second bus electrode which are in common will be sometimes referred to as "common bus electrode", and when the first bus electrode and the second bus electrode are explained hereinafter, these can be read as a common bus electrodes.

In the plasma display device according to the eighth aspect of the present invention, the first portion of the dielectric material layer may be formed by stacking the first dielectric material layer and the second dielectric material layer in this order from the first substrate, or by stacking the second dielectric material layer and the first dielectric material layer in this order from the first substrate.

The plasma display device according to the eighth aspect of the present invention is a so-called tri-electrode type surface-discharge type plasma display device. The plasma display device according to the eighth aspect of the present invention is structured as follows. The first panel and the second panel are arranged such that the dielectric material layer and the fluorescence layers face each other, the extending direction of projection image of the first electrodes (more specifically, the bus electrodes) and the extending direction of projection image of the second electrodes makes a predetermined angle (for example, 90°), a space surrounded by the dielectric material layer, the fluorescence layer and a pair of the separation walls is charged with a rare gas, and the fluorescence layer emits light when irradiated with vacuum ultraviolet ray generated on the basis of AC glow discharge in the rare gas between a pair of the facing sustain electrodes. A region where one first electrode (a combination of a pair of the first sustain electrode and the second sustain electrode and a pair of the first bus electrode and the second bus electrode) and a pair of the separation walls overlap corresponds to one discharge cell (one sub-pixel). The extending direction of the first electrodes (more specifically, the bus electrodes) will be referred to as "first direction", and the extending direction of the second electrodes will be referred to as "second direction", hereinafter.

The plasma display device production method according to a first aspect of the present invention for achieving the above first object is a method for producing an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, said method including a step of forming the dielectric material layer having a thickness of $1.5\times10^{-5}$ m or less, preferably $1.0\times10^{-5}$ m or less on the first substrate and the sustain electrodes by a physical vapor deposition method (PVD method) such as a sputtering method, a vacuum deposition method or an ion plating method or a chemical vapor deposition method (CVD method). The above PVD method or CVD method makes it possible to form a dielectric material layer having a small and uniform layer thickness.

Although differing depending upon materials for the dielectric material layer, specifically, the above PVD method includes;

(a) various vacuum deposition methods such as an electron beam heating method, a resistance heating method and a flash deposition method, (b) a plasma deposition method, (c) various sputtering methods such as a diode sputtering method, a DC sputtering method, a DC magnetron sputtering method, a high-frequency sputtering method, a magnetron sputtering method, an ion-beam sputtering method and a bias sputtering method, and (d) various ion-plating methods such as a DC (direct current) method, an RF method, a multi-cathode method, an activation reaction method, an electric field deposition method, a high-frequency ion-plating method and a reactive ion plating method.

Although differing depending upon a material for the dielectric material layer, the CVD method includes an atmospheric pressure CVD method (APCVD method), a reduced pressure CVD method (LPCVD method), a low-temperature CVD method, a high-temperature CVD method, a plasma CVD method (PCVD method, PECVD method), an ECR plasma CVD method, a photo CVD method and an MOCVD method.

The plasma display device production method according to a second aspect of the present invention for achieving the above first object is a method for producing an alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, said method including a step of forming the dielectric material layer having a thickness of $1.5\times10^{-5}$ m or less, preferably $1.0\times10^{-5}$ m or less on the first substrate and the sustain electrodes from a solution containing a dielectric material.

In the plasma display device production method according to the second aspect of the present invention, the step of forming the dielectric material layer may comprise a step of applying the solution containing a dielectric material onto the first substrate and the sustain electrodes by a spin-coating method. Alternatively, in the above method, the step of forming the dielectric material layer may comprise a step of screen-printing the solution (including a paste) containing a dielectric material on the first substrate and the sustain electrodes. The solution containing a dielectric material includes a water glass and a suspension of glass powders. Although differing depending upon a material for the dielectric material, the application of the solution containing a dielectric material is followed by drying, and calcining or sintering, whereby the dielectric material layer can be obtained.

The above water glass can be selected from No. 1 to No. 4 water glasses defined in Japanese Industrial Standard (JIS) K1408 or materials equivalent thereto. The No. 1 to No. 4 refer to four grades based on differences (approximately 2 to 4 mol) in molar amount of silicon oxide ($SiO_2$) per mole of sodium oxide ($Na_2O$) as a component of the water glasses, and the No. 1 to No. 4 water glasses greatly differ from one another in viscosity. When water glass is used, therefore, a water glass of an optimum grade having a viscosity suitable for screen printing is selected, or water glass equivalent to such a grade is prepared. The solvent for the water glass includes water and organic solvents such as alcohols. For attaining a viscosity suitable for the screen printing, preferably, a dispersing agent or a surfactant is added.

The plasma display device production method according to a third aspect of the present invention for achieving the above second object is a method for producing the plasma display device according to the eighth aspect of the present invention including the plasma display device according to the first or second constitution of the present invention. That is, the above method is for producing an alternating current driven type plasma display device comprising;

(1) a first panel having a first substrate; a first electrode group consisting of a plurality of first electrodes formed on the first substrate; and a dielectric material layer which covers the first electrodes and comprises a first dielectric material layer and a second dielectric material layer, and (2) a second panel having a second substrate; a second electrode group consisting of a plurality of second electrodes extending while making a predetermined angle with the extending direction of the first electrodes, said second electrodes being formed on the second substrate; separation walls each of which is formed between one second electrode and another neighboring second electrode; and fluorescence layers formed on or above the second electrodes, wherein each first electrode comprises;

(A) a first bus electrode, (B) first sustain electrode being in contact with the first bus electrode, (C) a second bus electrode extending in parallel with the first bus electrode, and (D) a second sustain electrode being in contact with the second bus electrode and facing the first sustain electrode, and wherein discharge takes place between the first sustain electrode and the second sustain electrode, said method including the steps of;

(a) forming the first electrode group on the first substrate, and (b) either covering the first electrodes with the first dielectric material layer, followed by forming the second dielectric material layer on portions of the first dielectric material layer above the first bus electrode and the second bus electrode, or covering the first bus electrode and the second bus electrode with the second dielectric material layer, following by covering the first electrode with the first dielectric material layer.

In the step (b) in the alternating current driven type plasma display device production method according to the third aspect of the present invention, the first electrode is covered with the first dielectric material layer and then the second dielectric material layer is formed on the portions of the first dielectric material layer above the first bus electrode and the second bus electrode. In this case, the first portion of the dielectric material layer has a constitution in which the first dielectric material layer and the second dielectric material layer are stacked in this order from the first substrate side. The above "covering of the first electrode with the first dielectric material layer" means the formation of the first dielectric material layer on (upper surfaces and side surfaces of) the first sustain electrode constituting the first electrode, the first bus electrode, the second sustain electrode and the second bus electrode. The formation of the second dielectric material layer on the portions of the first dielectric material layer above the first bus electrode and the second bus electrode means the formation of the second dielectric material layer on top surfaces and side surfaces of the first bus electrode and the second bus electrode through the first dielectric material layer.

Otherwise, in the step (b) in the plasma display device production method according to the third aspect of the present invention, the first bus electrode and the second bus electrode are covered with the second dielectric material layer and then the first electrode is covered with the first dielectric material layer. In this case, the first portion of the dielectric material layer has a constitution in which the second dielectric material layer and the first dielectric material layer are stacked in this order from the first substrate side. The above "covering of the first electrode with the first dielectric material layer" means the formation of the first dielectric material layer on (upper surfaces and side surfaces of) the first sustain electrode, the first bus electrode, the second sustain electrode and the second bus electrode constituting the first electrode. Further, the above "forming the second dielectric material layer on portions of the first dielectric material layer above the first bus electrode and the second bus electrode" means the formation of the second dielectric material layer on the top surfaces and the side surfaces of the first bus electrode and the second bus electrode through the first dielectric material layer.

In the plasma display device according to the eighth aspect of the present invention or the production method according to the third aspect of the present invention, preferably, the second portion of the dielectric material layer which portion covers the first and second sustain electrodes has a thickness of $1\times10^{-5}$ m or less for complying with demands of higher density of pixels and lower driving voltage. The thickness of the second portion of the dielectric material layer which portion covers the first and second sustain electrodes refers to a thickness in the top surfaces of the first and second sustain electrodes. The lower limit of the thickness of the second portion of the dielectric material layer can be such a thickness that no abnormal discharge takes place between the first sustain electrode and the second sustain electrode, and desirably, the lower limit is, for example, $1\times10^{-6}$ m, preferably $2\times10^{-6}$ m.

In the plasma display device according to the eighth aspect of the present invention or the production method according to the third aspect of the present invention, desirably, the second dielectric material layer of the top surfaces of the first bus electrode and the second bus electrode has a thickness ($t_2$) of $5\times10^{-6}$ m to $3\times10^{-5}$ m, preferably $1\times10^{-5}$ m to $2\times10^{-5}$ m, from the viewpoint of preventing abnormal discharge between the bus electrode and the second electrode.

In the plasma display device according to the first constitution of the present invention or the production method thereof, the first dielectric material layer and the second dielectric material layer may be formed on the first substrate between the first bus electrode constituting the first electrode and the second bus electrode constituting the first electrode neighboring on said first electrode. This constitution can effectively prevent abnormal discharge between the first bus electrode constituting the first electrode and the second bus electrode constituting the first electrode neighboring on said first electrode.

In the plasma display device according to the eighth aspect of the present invention or in the step (b) of the production method according to the third aspect of the present invention, the second dielectric material layer may be further formed on or above a region of the first panel which region corresponds to the separation wall formed in the second panel. This constitution can reliably prevent a so-called optical crosstalk phenomenon in which glow discharge has an influence on neighboring discharge cells.

In the plasma display device according to the eighth aspect of the present invention or the production method according to the third aspect of the present invention, preferably, the material constituting the first dielectric material layer differs from the material constituting the second dielectric material layer. There may be employed a constitution in which the first dielectric material layer is composed of silicon oxide ($SiO_2$) and the second dielectric material layer is composed of a calcined or sintered product of a glass plate (more specifically, a low-melting glass paste). In this constitution, preferably, the first dielectric material layer is formed by a chemical vapor deposition method (CVD method) or a physical vapor deposition method (PVD method) such as a sputtering method and a vacuum deposition method, and the second dielectric material layer is formed by a printing method (screen printing method). If the first dielectric material layer is formed particularly by a CVD method, there can be reliably formed the first dielectric material layer which is conformal and is excellent in step coverage and layer thickness uniformity.

In the plasma display device according to the eighth aspect of the present invention or the production method according to the third aspect of the present invention, the second dielectric material layer may be colored. In this case, the second dielectric material layer can exhibit a function of a black matrix, and a contrast among pixels in the second direction can be improved.

In the plasma display device according to the eighth aspect of the present invention or the production method according to the third aspect of the present invention, the first bus electrode and the second bus electrode are common in discharge cells neighboring on each other in the first direction. The first sustain electrode and the second sustain electrode may be common in discharge cells neighboring on each other in the first direction (that is, the first sustain electrode may extend in parallel with the first bus electrode and the second sustain electrode may extend in parallel with the second bus electrode), or may be formed between a pair of separation walls (that is, they may be formed for each discharge cell). A portion of the first sustain electrode which portion faces the second sustain electrode and a portion of the second sustain electrode which portion faces the first sustain electrode may be linear or may be in a zigzag form (for example, a combination of "dogleg" forms, a combination of "S" letters, a combination of arc forms or a combination of any curved forms). When the first sustain electrode and the second sustain electrode are formed between a pair of the separation walls, the plan form of the first sustain electrode and the second sustain electrode may have a constitution in which, as shown in FIG. 14, the first sustain electrode extends from the first bus electrode toward the second bus electrode in parallel with the second direction, the second sustain electrode extends from the second bus electrode toward the first bus electrode in parallel with the second direction, and discharge such as glow discharge takes place between a top end portion of the first sustain electrode and a top end portion of the second sustain electrode. Alternatively, there may be employed a constitution in which, as shown in FIG. 15 or 16, the first sustain electrode extends from the first bus electrode toward the second bus electrode and extends short of the second bus electrode in parallel with the second direction, the second sustain electrode extends from the second bus electrode toward the first bus electrode and extends short of the first bus electrode in parallel with the second direction so as to face the first sustain electrode (or along the first sustain electrode), and discharge such as glow discharge takes place between a portion (side surface) of the first sustain electrode which portion faces the second sustain electrode and a portion (side surface) of the second sustain electrode which portion faces the first sustain electrode.

In the plasma display device according to the eighth aspect of the present invention or the production method according to the third aspect of the present invention, the distance ($L_1$) between the first sustain electrode and the second sustain electrode may essentially have any value. However, desirably, it is $1\times10^{-4}$ m or less, preferably less than $5\times10^{-5}$ m, more preferably $4\times10^{-5}$ m or less, still more preferably $2.5\times10^{-5}$ m or less. The lower limit of the distance ($L_1$) between the first sustain electrode and the second sustain electrode can be determined to be any value while taking account of the thickness of the dielectric material layer, etc., such that no dielectric breakdown takes place between the first sustain electrode and the second sustain electrode.

The plasma display device according to any one of the first to eighth aspects of the present invention will be explained below by referring, for example, to a tri-electrode type plasma display device. With regard to a bi-electrode type plasma display device, the second electrode in the following explanation can be read as "the other sustain electrode".

In the plasma display device according to any one of the first to seventh aspects of the present invention or the production method according to the first and second aspects of the present invention, there may be also employed a constitution in which, in addition to the sustain electrode, a bus electrode composed of a material having a lower electric resistivity than the sustain electrode is formed in contact with the sustain electrode for decreasing the impedance of the sustain electrode as a whole. In the plasma display device according to any one of the first to eighth aspects of the present invention or the production method according to any one of the first to third aspects of the present invention, it is preferred to employ a constitution in which the electrically conductive material for the sustain electrode and the electrically conductive material for the bus electrode differ from each other. Typically, the bus electrode can be composed, for example, of Ag, Au, Al, Ni, Cu, Mo, Cr or a Cr/Cu/Cr stacked film. The bus electrode composed of the above metal material in a reflection-type plasma display device decreases the transmitted-light quantity of visible light which is emitted from the fluorescence layer and passes through the first substrate, so that the brightness of a display screen is decreased. It is therefore preferred to form the bus electrode so as to be as narrow as possible so long as an electric resistance value necessary for the bus electrode can be obtained. The bus electrode can be formed, for example, by a deposition method, a sputtering method, a printing method (screen printing method), a sand blasting method, a plating method or a lift-off method as required depending upon an electrically conductive material used. That is, the bus electrode having a predetermined pattern from the beginning can be formed with a proper mask or a screen, or the bus electrode can be formed by forming an electrically conductive material layer on the entire surface and then patterning the electrically conductive material layer.

In the plasma display device according to any one of the first to eighth aspects of the present invention or the production method according to any one of the first to third aspects of the present invention, the electrically conductive material for the sustain electrode differs depending upon whether the plasma display device is a transmission type or a reflection type. In the transmission type plasma display device, light emission from the fluorescence layer is observed through the second panel, so that it is not any problem whether the electrically conductive material constituting the sustain electrode is transparent or non-transparent. However, since the second electrode (address electrode) is formed on the second substrate, the second electrode is desirably transparent. In the reflection type plasma display device, light emission from the fluorescence layers is observed through the first substrate, so that it is not a problem whether the electrically conductive material constituting the second electrode (address electrode) is transparent or non-transparent. However, the electrically conductive material constituting the sustain electrodes is desirably transparent. The term "transparent or non-transparent" is based on the transmissivity of the electrically conductive material to light at a wavelength of emitted light (in visible light region) inherent to fluorescence materials. That is, when an electrically conductive material constituting the sustain electrode is transparent to light emitted from the fluorescence layers, it can be said that the electrically conductive material is transparent. The non-transparent electrically conductive material includes Ni, Al, Au, Ag, Pd/Ag, Cr, Ta, Cu, Ba, $LaB_6$, $Ca_{0.2}La_{0.8}CrO_3$, etc., and these materials may be used alone or in combination. The transparent electrically conductive material includes ITO (indium-tin oxide) and $SnO_2$. The sustain electrode can be formed, for example, by a deposition method, a sputtering method, a printing method (screen printing method), a sand blasting method, a plating method or a lift-off method as required depending upon an electrically conductive material used. That is, the sustain electrode having a predetermined pattern from the beginning can be formed with a proper mask or a screen, or the sustain electrode can be formed by forming an electrically conductive material layer on the entire surface and then patterning the electrically conductive material layer.

In the reflection type plasma display device, the material for the dielectric material layer is required to be transparent since light emitted from the fluorescence layer is observed through the first substrate.

In the plasma display device according to the eighth aspect of the present invention or the production method according to the third aspect of the present invention, preferably, a protective layer is formed at least on the surface of the second portion of the dielectric material layer which portion covers the first sustain electrode and the second sustain electrode. The protective layer may be formed not only on the second portion but also on the surface of the first portion of the dielectric material layer which portion covers the first bus electrode and the second bus electrode. The protective layer may have a single-layered structure or a stacked-layered structure. In the plasma display device production method according to the third aspect of the present invention, the protective layer may be formed after the step (b), or in the step (b), the protective layer may be formed after the first electrodes are covered with the first dielectric material layer, followed by the formation of the second dielectric material layer on the portion of the first dielectric material layer (more specifically, on the protective layer) above the first bus electrode and the second bus electrode. The material constituting the protective layer having a single-layered structure includes magnesium oxide (MgO), magnesium fluoride ($MgF_2$), calcium fluoride ($CaF_2$) and aluminum oxide ($Al_2O_3$). Of these, magnesium oxide is a suitable material having properties such as chemical stability, a low sputtering ratio, a high light transmissivity at a wavelength of light emitted from the fluorescence layers and a low discharge initiating voltage. The protective layer may have a stacked-layered structure composed of at least two materials selected from the group consisting of magnesium oxide, magnesium fluoride and aluminum oxide. When the protective layer is formed, the direct contact of ions or electrons to the first electrode group can be prevented, and as a result, the wearing of the first electrodes can be prevented. The protective layer also works to emit secondary electrons necessary for glow discharge.

In the plasma display device according to the eighth aspect of the present invention or the production method according to the third aspect of the present invention, the second electrode is formed on the second substrate. If the function of the fluorescence layer as a dielectric substance layer is insufficient, a dielectric substance layer may be formed between the second electrode group and the fluorescence layer. The material for the dielectric substance layer can be selected from a low-melting glass or $SiO_2$.

The fluorescence layer is composed of a fluorescence material selected from the group consisting of a fluorescence material which emits light in red, a fluorescence material which emits light in green and a fluorescence material which emits light in blue. The fluorescence layer is formed on or above the second substrate (or the second electrode). Specifically, the fluorescence layer composed of a fluorescence material which emits light, for example, of a red color (red fluorescence layer) is formed on or above the second electrode, the fluorescence layer composed of a fluorescence material which emits light, for example, of a green color (green fluorescence layer) is formed on or above another second electrode, and the fluorescence layer composed of a fluorescence material which emits light, for example, of a blue color (blue fluorescence layer) is formed on or above still another second electrode. These three fluorescence layers for emitting light of three primary colors form one set, and such sets are formed in a predetermined order. A region where one first electrode (a combination of a pair of the first bus electrode and the second bus electrode and a pair of the first sustain electrode and the second sustain electrode) and one set of the fluorescence layers which emit light of three primary colors overlap corresponds to one pixel. The red fluorescence layers, the green fluorescence layers and the blue fluorescence layers may be formed in the form of stripes, or may be formed in the form of dots. When the red fluorescence layer, the green fluorescence layer and the blue fluorescence layer are formed in the form of stripes, one red fluorescence layer is formed on or above one second electrode, one green fluorescence layer is formed on or above one second electrode, and one blue fluorescence layer is formed on or one second electrode. When the red fluorescence layer, the green fluorescence layer and the blue fluorescence layer are formed in the form of dots, the red fluorescence layer, the green fluorescence layer and the blue fluorescence layer are formed on or above one second electrode in a predetermined order. Further, the fluorescence layers may be formed only on regions where the sustain electrodes and the second electrodes overlap.

The fluorescence layer may be formed directly on the second electrode, or it may be formed on the second electrode and on the side walls of the separation walls. Alternatively, the fluorescence layer may be formed on the dielectric substance layer formed on the second electrode or may be formed on the dielectric substance layer formed on the second electrode and on the side walls of the separation walls. Alternatively, the fluorescence layer may be formed only on the side walls of the separation walls. The formation of the fluorescence layer on or above the second electrode includes all of the above various embodiments.

The material for the dielectric substance layer includes a low-melting glass and silicon oxide, and it can be formed by a screen printing method, a sputtering method or a vacuum deposition method. In some cases, a protective layer composed of magnesium oxide (MgO), magnesium fluoride ($MgF_2$) or calcium fluoride ($CaF_2$) may be formed on the fluorescence layer and the separation wall.

As the fluorescence material for constituting the fluorescence layers, fluorescence materials which have high quantum efficiency and cause less saturation to vacuum ultraviolet ray can be selected from known fluorescence materials as required. When the plasma display device is used as a color display, it is preferred to combine those fluorescence materials which have color purities close to three primary colors defined in NTSC, which have an excellent white balance when three primary colors are mixed, which show a small afterglow time period and which can secure that the afterglow time periods of three primary colors are nearly equal. Examples of the fluorescence material which emits light in red when irradiated with vacuum ultraviolet ray include ($Y_2O_3$:Eu), ($YBO_3$Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu) and ($3.5MgO \cdot 0.5MgF_2 \cdot GeO_2$:Mn). Examples of the fluorescence material which emits light in green when irradiated with vacuum ultraviolet light include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb) and ($Sr_4Si_3O_8Cl_4$:Eu). Examples of the fluorescence material which emits light in blue when irradiated with vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn). The method for forming the fluorescence layers includes a thick film printing method, a method in which fluorescence material particles are sprayed, a method in which an adhesive substance is pre-applied to regions where the fluorescence layers are to be formed and fluorescence particles are allowed to adhere, a method in which a photosensitive fluorescence paste is provided and a fluorescence layer is patterned by exposure and development of the photosensitive fluorescence paste, and a method in which a fluorescence layer is formed on the entire surface and unnecessary portions thereof are removed by a sand blasting method.

The separation walls may have a constitution in which they extend in regions between neighboring second electrodes in parallel with the second electrodes. That is, there may be employed a constitution in which one second electrode extends between a pair of the separation walls. In some cases, the separation walls may have a constitution in which a first separation wall extends in a region between neighboring bus electrodes in parallel with the bus electrodes and a second separation wall extends in a region between neighboring second electrodes in parallel with the second electrodes (that is, in the form of a grille). While the separation walls in the form of a grille (lattice) are conventionally used in a DC driven type plasma display device, they can be applied to the plasma display device of the present invention. The separation walls (ribs) may have a meander structure. When the dielectric substance layer is formed on the second substrate and on the address electrode, the separation walls may be formed on the dielectric substance layer in some cases.

The material for the separation wall can be selected from a known insulating material. For example, a mixture of a widely used low-melting glass with a metal oxide such as alumina can be used. The separation wall can be formed by a screen printing method, a sand blasting method, a dry filming method and a photosensitive method. The above screen printing method refers to a method in which opening portions are made in those portions of a screen which correspond to portions where the separation walls are to be formed, a separation-wall-forming material on the screen is passed through the opening portions with a squeeze to form a separation-wall-forming material layer on the second substrate or the dielectric substance layer (these will be generically referred to as "second substrate or the like" hereinafter), and then the separation-wall-forming material layer is calcined or sintered. The above dry filming method refers to a method in which a photosensitive film is laminated on the second substrate or the like, the photosensitive film on regions where the separation walls are to be formed is removed by exposure and development, opening portions formed by the removal are filled with a separation-wall-forming material and the separation-wall-forming material is calcined or sintered. The photosensitive film is combusted and removed by the calcining or sintering and the separation-wall-forming material filled in the opening portions remains to constitute the separation walls. The above photosensitive method refers to a method in which a photosensitive material layer for forming the separation walls is formed on the second substrate or the like, the photosensitive material layer is patterned by exposure and development and then the patterned photosensitive material layer is calcined or sintered. The above sand blasting method refers to a method in which a separation-wall-forming material layer for forming the separation walls is formed on the second substrate or the like, for example, by screen printing or with a roll coater, a doctor blade or a nozzle-ejecting coater and is dried, then, those portions where the separation walls are to be formed in the separation-wall-forming material layer are covered with a mask layer and exposed portions of the separation-wall-forming material layer are removed by a sand blasting method. The separation walls may be formed in black to form a so-called black matrix. In this case, a high contrast of the display screen can be attained. The method of forming the black separation walls includes a method in which a light-absorbing layer such as a photosensitive silver paste layer or a low-reflection chromium layer is formed on the top portion of each separation wall and a method in which the separation walls are formed from a color resist material colored in black.

The material constituting the first substrate for the first panel and the second substrate for the second panel includes high-distortion-point glass, soda glass ($Na_2O \cdot CaO \cdot SiO_2$), borosilicate glass ($Na_2O \cdot B_2O_3 \cdot SiO_2$), forsterite ($2MgO \cdot SiO_2$) and lead glass ($Na_2O \cdot PbO \cdot SiO_2$). The material constituting the first substrate and the material constituting the second substrate may be the same as, or different from, each other.

One discharge cell is constituted of a pair of the separation walls formed above the second panel, the sustain electrodes and the second electrode occupying a region surrounded by a pair of the separation walls, and the fluorescence layer (for example, one fluorescence layer of the red fluorescence layer, the green fluorescence layer and the blue fluorescence layer). The discharge gas consisting of a mixed gas is sealed in the above discharge cell, more specifically, the discharge space surrounded by the separation walls, and the fluorescence layer emits light when irradiated with vacuum ultraviolet ray generated by AC glow discharge which takes place in the discharge gas in the discharge space.

In the plasma display device of the present invention, desirably, a rare gas charged in the space surrounded by the dielectric material layer, the fluorescence layer and a pair of the separation walls has a pressure of $1.0 \times 10^2$ Pa (0.001 atmospheric pressure) to $5 \times 10^5$ Pa (5 atmospheric pressures), preferably $1 \times 10^3$ Pa (0.01 atmospheric pressure) to $4 \times 10^5$ Pa (4 atmospheric pressures). When the distance $L_1$ between a par of the sustain electrodes is less than $5 \times 10^{-5}$ m, desirably, the pressure of the rare gas in the space is $1.0 \times 10^2$ Pa (0.001 atmospheric pressure) to $3.0 \times 10^5$ Pa (3 atmospheric pressures), preferably $1.0 \times 10^3$ Pa (0.01 atmospheric pressure) to $2.0 \times 10^5$ Pa (2 atmospheric pressures), more preferably $1.0 \times 10^4$ Pa (0.1 atmospheric pressure) to $1.0 \times 10^5$ Pa (1 atmospheric pressure). When the pressure of the rare gas is adjusted to the above pressure range, the fluorescence layer emits light when irradiated with vacuum ultraviolet ray generated mainly on the basis of cathode glow in the rare gas. With an increase in pressure in the above pressure range, the sputtering ratio of various members constituting the plasma display device decreases, which results in an increase in the lifetime of the plasma display device.

The rare gas to be sealed in the space is required to satisfy the following requirements.

(1) The rare gas is chemically stable and permits setting of a high gas pressure from the viewpoint of attaining a longer lifetime of the plasma display device.

(2) The rare gas permits the high radiation intensity of vacuum ultraviolet ray from the viewpoint of attaining higher brightness of a display screen.

(3) Radiated vacuum ultraviolet ray has a long wavelength from the viewpoint of increasing energy conversion efficiency from vacuum ultraviolet ray to visible light.

(4) The discharge initiating voltage is low from the viewpoint of decreasing power consumption.

The rare gas includes He (wavelength of resonance line= 58.4 nm), Ne (ditto=74.4 nm), Ar (ditto=107 nm), Kr (ditto=124 nm) and Xe (ditto=147 nm). While these rare gases may be used alone or as a mixture, mixed gases are particularly useful since a decrease in the discharge initiating voltage based on a Penning effect can be expected. Examples of the above mixed gases include Ne—Ar mixed gases, He—Xe mixed gases, Ne—Xe mixed gases, He—Kr mixed gases, Ne—Kr mixed gases and Xe—Kr mixed gases. Of these rare gases, Xe having the longest resonance line wavelength is suitable since it also radiates intense vacuum ultraviolet ray having a wavelength of 172 nm.

The light emission state of glow discharge in a discharge cell will be explained below with reference to FIGS. 21A, 21B, 22A and 22B. FIG. 21A schematically shows a light emission state when DC glow discharge is carried out in a discharge tube with a rare gas sealed therein. From a cathode to an anode, an Aston dark space A, a cathode glow B, a cathode dark space (Crookes dark space) C, negative glow D, a Faraday dark space E, a positive column F and anode glow G consecutively appear. In AC glow discharge, it is thought that since a cathode and an anode are repeatedly inverted at a predetermined frequency, the positive column F is positioned in a central area between the electrodes, and the Faraday dark spaces E, the negative glows D, the cathode dark spaces C, the cathode glows B and the Aston dark spaces A consecutively appear symmetrically on both sides of the positive column F. A state shown in FIG. 21B is observed when the distance between the electrodes is sufficiently large like a fluorescent lamp.

As the distance between the electrodes is decreased, the length of the positive column F decreases. When the distance between the electrodes is further decreased, presumably, the positive column F disappears, the negative glow D is positioned in the central area between the electrodes, and the cathode dark spaces C, the cathode glows B and the Aston dark spaces A appear symmetrically on both sides in this order as shown in FIG. 22A. The state shown in FIG. 22A is observed when the distance between the electrodes is approximately $1\times10^{-4}$ m. In the tri-electrode type plasma display device, the negative glow is formed in a space region near a surface portion of the dielectric material layer which portion covers one sustain electrode corresponding to the cathode or in a space region near a surface portion of the dielectric material layer which portion covers the other sustain electrode corresponding to the cathode.

When the distance between the electrodes comes to be less than $5\times10^{-5}$ m, presumably, the cathode glow B is positioned in the central area between the electrodes and the Aston dark spaces A appear on both sides of the cathode glow B as is schematically shown in FIG. 22B. In some cases, the negative glow can partly exist. In the tri-electrode type plasma display device, the cathode glow is formed in a space region near a surface portion of the dielectric material layer which portion covers one sustain electrode corresponding to the cathode or a space region near a surface portion of the dielectric material layer which portion covers the other sustain electrode corresponding to the cathode. When the distance between a pair of the sustain electrodes is arranged to be less than $5\times10^{-5}$ m as described above, and when the pressure in the space is adjusted to $1.0\times10^{2}$ Pa (0.001 atmospheric pressure) to $3.0\times10^{5}$ Pa (3 atmospheric pressures), the cathode glow can be used as a discharge mode. A high AC glow discharge efficiency can be therefore achieved, and as a result, a high light-emission efficiency and high brightness can be attained in the plasma display device.

BRIEF DESCRIPTION OF THE DRAWINGS

The present invention will be explained with reference to drawings hereinafter.

DESCRIPTION OF THE PREFERRED EMBODIMENTS

EXAMPLE 1

Figure 1:
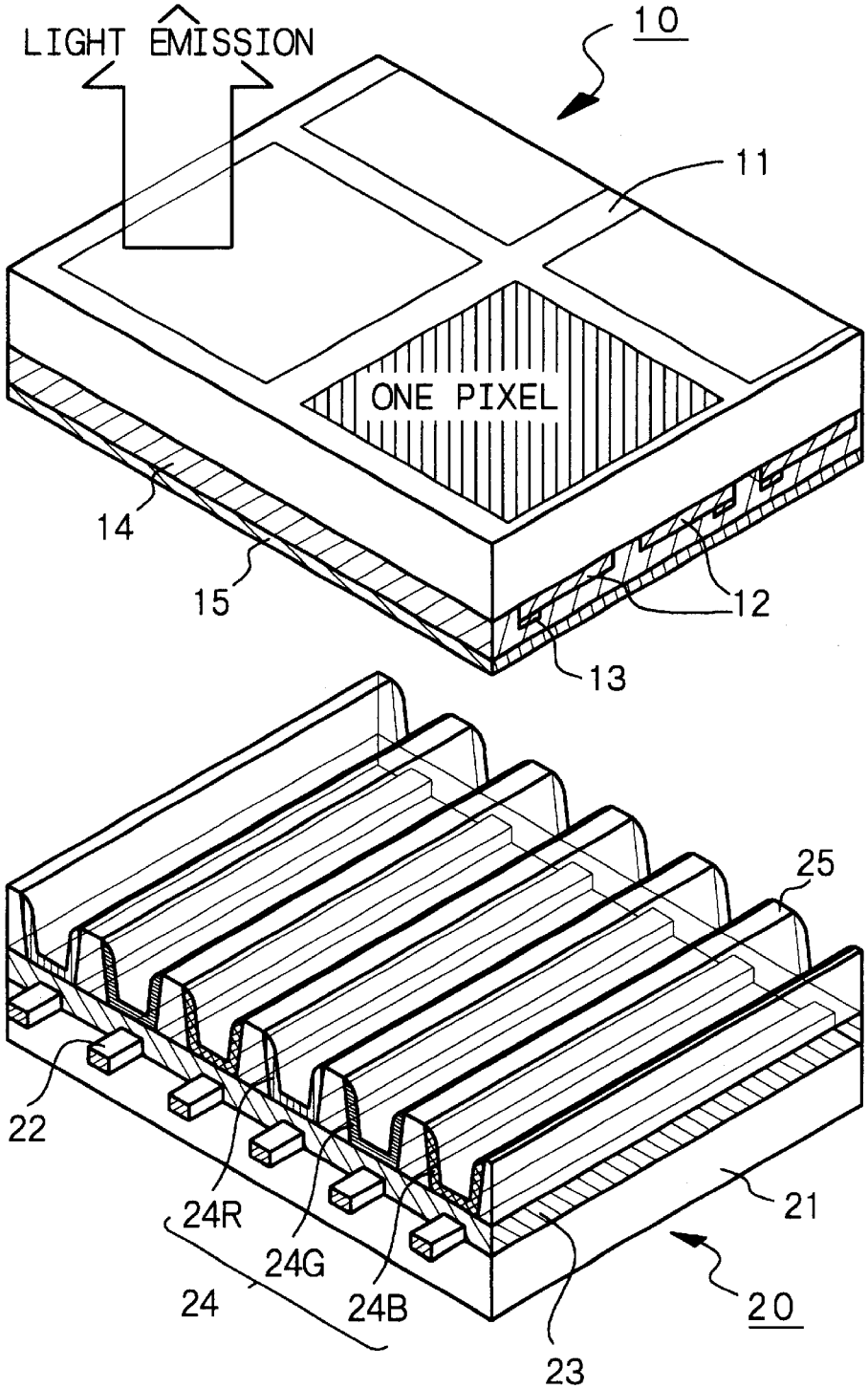
FIG. 1 is a schematic partial exploded perspective view of a general constitution of a tri-electrode type plasma display device.

Example 1 is concerned with the alternating current driven type plasma display devices (to be referred to as "plasma display device" hereinafter) according to the first and fourth aspects of the present invention. The plasma display device of Example 1 has a characteristic feature in that a dielectric material layer has a thickness of $1.5\times10^{-5}$ m or less. The dielectric material layer comprised a first dielectric material film composed of silicon oxide ($SiO_x$) and a second dielectric material film composed of MgO and formed thereon. A tri-electrode type plasma display device according to the first aspect of the present invention, having a structure shown in FIG. 1, was produced by a method to be explained below.

The first panel 10 was produced by the following method. First, an ITO layer was formed on the entire surface of the first substrate 11 composed of high-distortion-point glass or soda glass by a sputtering method, and the ITO layer was patterned in the form of stripes by photolithography or an etching method, to form a plurality of pairs of the sustain electrodes 12. The sustain electrodes 12 extend in a first direction. Then, an aluminum film or a copper film was formed on the entire surface, for example, by a deposition method, and the aluminum film or the copper film was patterned by photolithography and an etching method, to form the bus electrode 13 along edge portions of the sustain electrodes 12. In each pair of the sustain electrodes 12, the distance between the sustain electrodes 12 was $2\times10^{-5}$ m (20 $\mu$m).

Then, the first dielectric material film 14 composed of silicon oxide was formed on the entire surface by a sputtering method using a high-frequency magnetron sputtering apparatus under a condition shown in Table 1 below. In this case, as the first dielectric material film 14, dielectric material films having a thickness of 1 $\mu$m, 3 $\mu$m and 6 $\mu$m were formed. Further, as the first dielectric material film 14, a dielectric material film composed mainly of silicon oxide was formed on the entire surface by a screen printing method. A paste was used as a solution containing a dielectric material. In this case, the first dielectric material film 14 had a thickness of 10 $\mu$m. Further, for reference purpose, as the first dielectric material film 14, a 20 $\mu$m thick first dielectric material film composed of silicon oxide was formed by a screen printing method.

TABLE 1

| | |
|---|---|
| Target | $SiO_2$ |
| Process gas | $Ar/O_2$ = 500/100 sccm |
| Ar gas power | $5\times10^{-1}$ Pa |
| RF power | 1 kW |

Then, a 0.6 $\mu$m thick second dielectric material film (protective layer) 15 composed of magnesium oxide (MgO) was formed on the first dielectric material film 14 by an electron beam deposition method. By the above steps, the first panel 10 was completed.

The second panel 20 was produced by the following method. First, a silver paste was printed in the form of stripes, on a second substrate 21 made of high-distortion-point glass or soda glass, for example, by a screen printing method and calcined or sintered to form the address electrodes 22. The address electrodes 22 extend in a second direction crossing the first direction at right angles. A low-melting glass paste layer was formed on the entire surface by a screen printing method, and the low-melting glass paste layer was calcined or sintered to form the dielectric substance layer 23. Then, a low-melting glass paste was printed on the dielectric substance layer 23 above regions between neighboring address electrodes 22, for example, by a screen printing method, and calcined or sintered to form the separation walls 25. The separation walls had an average height of 130 $\mu$m. Then, fluorescence material slurries of three primary colors were consecutively printed and calcined or sintered, to form the fluorescence layers 24R, 24G and 24B on the dielectric substance layer 23 between the separation walls 25 and on side walls of the separation walls 25. By the above steps, the second panel 20 was completed.

Then, a plasma display device was assembled. That is, first, a frit glass layer was formed in a circumferential portion of the second panel 20, for example, by screen printing. Then, the first panel 10 and the second panel 20 were bonded to each other and calcined or sintered to cure the frit glass layer. A space formed between the first panel 10 and the second panel 20 was vacuumed and then charged with a Ne—Xe mixed gas, and the space was sealed to complete the plasma display device.

Figure 2:
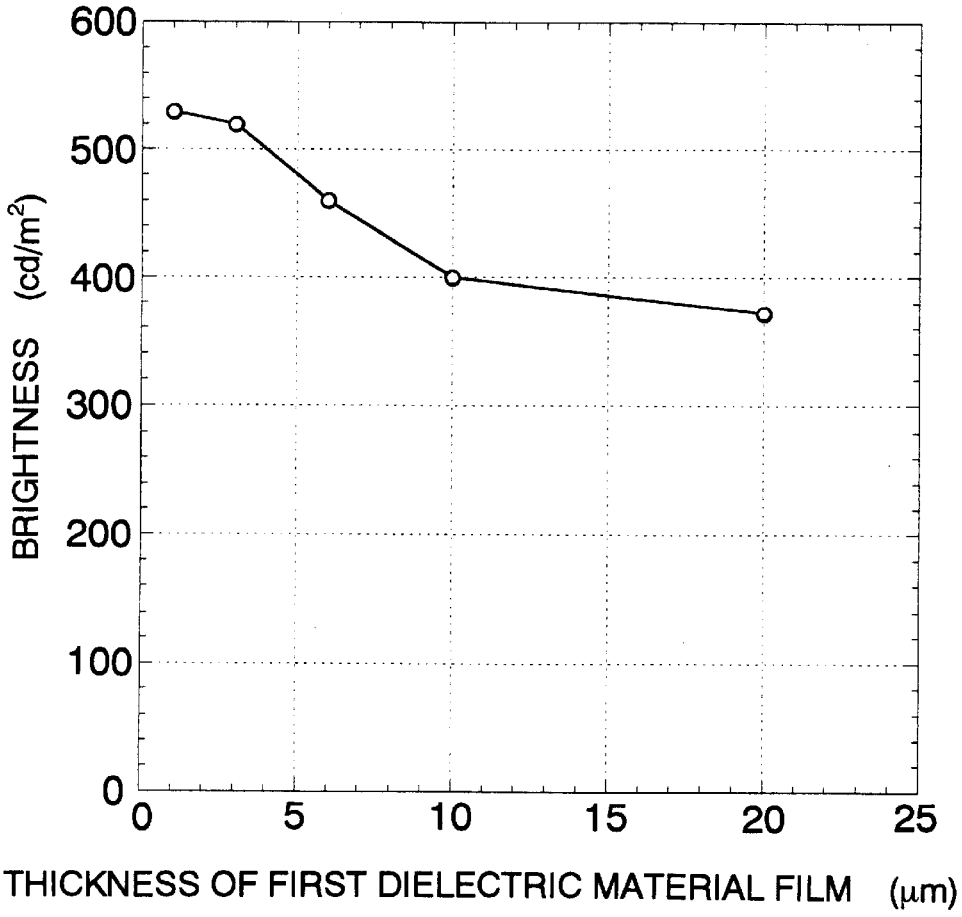
FIG. 2 is a graph showing brightness measurement results of the testing plasma display devices fabricated in Example 1.

The thus-produced plasma display devices for testing were measured for brightness. A voltage of 150 volts was applied for discharge. FIG. 2 shows the results. In addition, a plasma display device obtained by forming a 20 $\mu$m thick first dielectric material film 14 composed of silicon oxide by a screen printing method was measured for brightness, and the measurement value will be referred to as a reference value.

The results of the brightness measurements clearly showed that the brightness was improved when the dielectric material layer had a thickness of $1.5\times10^{-5}$ m (15 $\mu$m) or less, preferably $1.0\times10^{-5}$ m (10 $\mu$m) or less.

Figure 3:
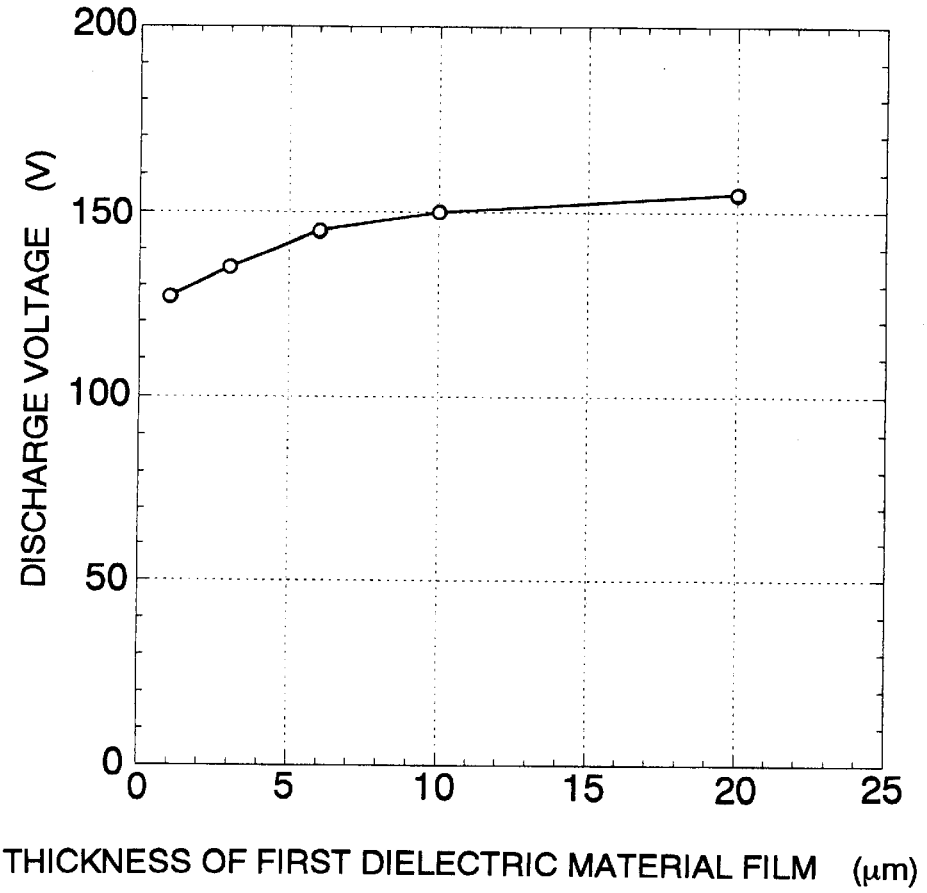
FIG. 3 is a graph showing discharge voltage measurement results of the testing plasma display devices fabricated in Example 1.

Further, the thus-produced plasma display devices for testing were measured for a discharge voltage. FIG. 3 shows the results.

The results of the discharge voltage measurements clearly showed that the discharge voltage decreased when the dielectric material layer had a thickness of $1.5\times10^{-5}$ m (15 $\mu$m) or less, preferably $1.0\times10^{-5}$ m (10 $\mu$m) or less.

The first dielectric material film composed of silicon oxide can be formed, for example, by a reduced-pressure CVD method using $SiH_4/O_2$ as source gases and an Ag gas as a carrier gas and employing 420° C. as a deposition temperature. Alternatively, the first dielectric material film composed of silicon oxide can be formed by an electron beam heating method using palletized $SiO_2$ as a target and $O_2$ as a process gas. Further, the first dielectric material film composed of silicon oxide can be formed by an ion plating method using $SiO_2$, SiO or Si as a deposition source and $O_2$ as a reactive gas. Further, the first dielectric material film composed of silicon oxide can be also formed by a spin coating method using a solution containing silicon oxide.

EXAMPLE 2

Example 2 is also concerned with the plasma display devices according to the first and fourth aspects of the present invention. In Example 2, the distance between a pair of the sustain electrodes 12 was varied, and a relationship between the brightness of a thus-obtained plasma display device and the distance between a pair of the sustain electrodes 12 was studied. In Example 2 or Examples 3 to 7, tri-electrode type plasma display devices structured as shown in FIG. 1 were produced.

In Example 2, the first panel 10 was produced by the following method. First, procedures up to the formation of the bus electrode 13 were carried out in the same manner as in Example 1. Then, a 3 $\mu$m thick first dielectric material film 14 composed of silicon oxide was formed on the entire surface in the same manner as in Example 1. Otherwise, a 10

μm thick first dielectric material film 14 composed of silicon oxide was formed on the entire surface by a screen printing method. Then, a 0.6 μm thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1. The distance (d) between a pair of the sustain electrodes 12 was varied to 10 μm, 20 μm, 40 μm and 70 μm.

Figure 4:
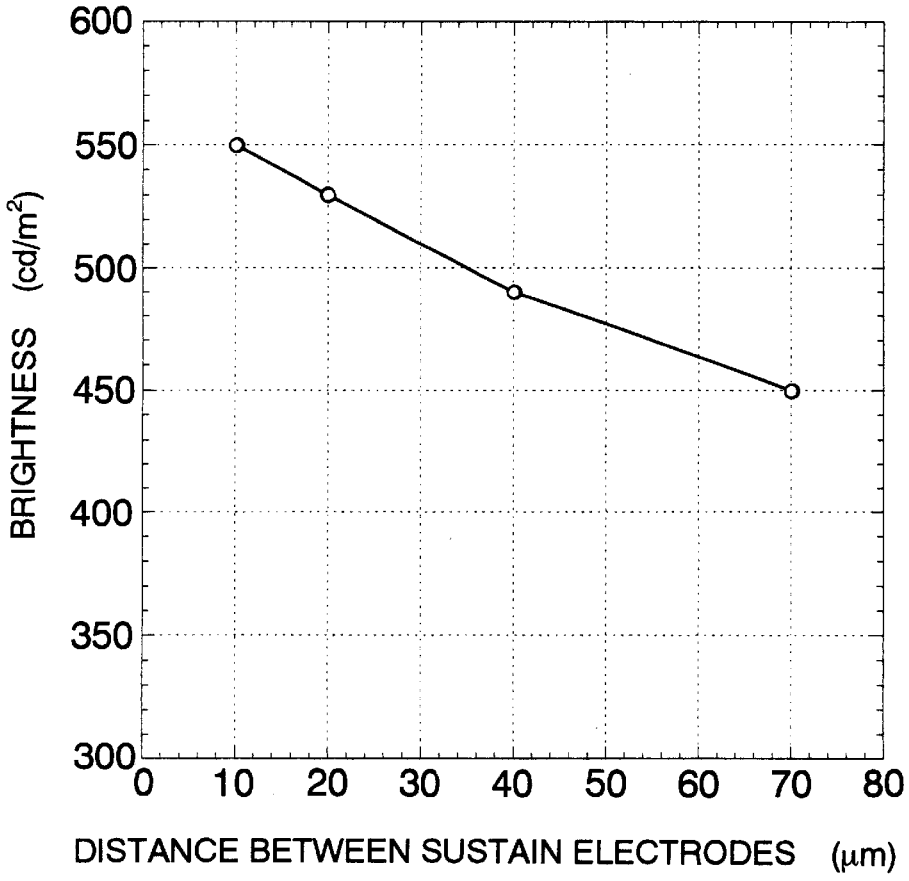
FIG. 4 is a graph showing brightness measurement results of the testing plasma display devices fabricated in Example 2 (thickness of the first dielectric material film: 3 $\mu$m).
Figure 5:
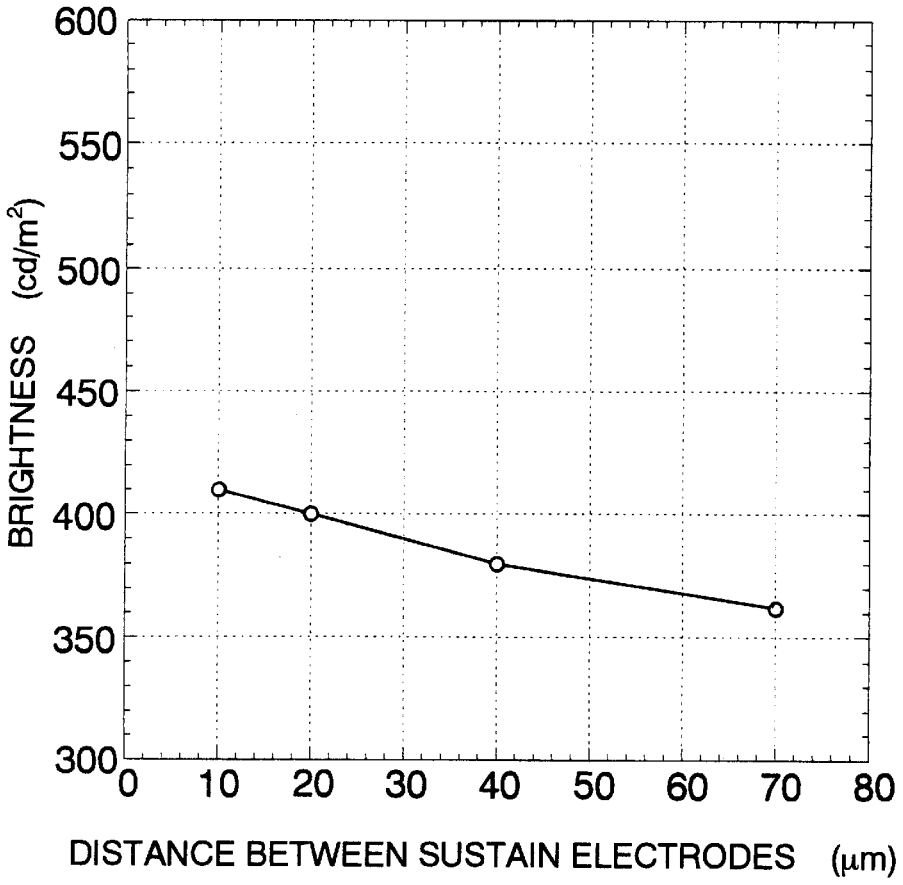
FIG. 5 is a graph showing brightness measurement results of the testing plasma display devices fabricated in Example 2 (thickness of the first dielectric material film: 10 $\mu$m).

The thus-produced plasma display devices for testing were measured for brightness. The voltage to be applied was set at the same level as that in Example 1. FIGS. 4 and 5 show the results.

As clearly shown in FIGS. 4 and 5, as the thickness of the first dielectric material film decreased, the brightness of the plasma display device increases, and as the distance between a pair of the sustain electrodes decreases, the brightness of the plasma display device increases.

EXAMPLE 3

Example 3 is concerned with the plasma display device according to the second aspect of the present invention. In the plasma display device of Example 3, the dielectric material layer comprised a first dielectric material film constituted of an aluminum oxide layer and a second dielectric material film composed of MgO and formed thereon.

The first panel was produced by the following method. First, procedures up to the formation of the bus electrode 13 were carried out in the same manner as in Example 1. Then, the first dielectric material film 14 composed of aluminum oxide was formed by an electron beam heating method under a condition shown in Table 2 below. In this case, the first dielectric material film 14 had a thickness of 1 μm to 20 μm. Then, a 0.6 μm thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1.

TABLE 2

| | |
|---|---|
| Deposition source | $Al_2O_3$ |
| Process gas | $O_2$ |
| $O_2$ gas pressure | $1 \times 10^{-2}$ Pa |
| RF power | 1 kW |
| Heating temperature | 200° C. |

The thus-produced plasma display devices for testing were measured for brightness. The voltage to be applied was set at the same level as that in Example 1. As a result, the plasma display device showed a higher value than a reference value even if the first dielectric material film 14 had a thickness of 20 μm. Further, as the thickness of the first dielectric material film decreased, the plasma display device exhibited a higher brightness value, and when the thickness of the dielectric material layer was particularly 15 μm or less, the plasma display device exhibited a far higher brightness value.

The first dielectric material film composed of aluminum oxide can be also formed by a sputtering method using $A1_2O_3$ or A1 as a target and $O_2$ as a process gas. Further, the first dielectric material film composed of aluminum oxide can be also formed by a sol-gel method.

EXAMPLE 4

Example 4 is concerned with the plasma display device according to the third aspect of the present invention. In the plasma display device of Example 4, the dielectric material layer comprised a first dielectric material film having a stacked structure constituted of an aluminum oxide layer and a silicon oxide layer, and a second dielectric material film composed of MgO and formed thereon.

The first panel 10 was produced by the following method. First, procedures up to the formation of the bus electrode 13 were carried out in the same manner as in Example 1. Then, an aluminum oxide layer (thickness 3 μm) was formed on the entire surface by an electron beam heating method under the condition shown in Table 2, and then a silicon oxide layer (thickness 3 μm) was formed thereon as explained in Example 1. Then, a 0.6 μm thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1.

The thus-produced plasma display device for testing was measured for brightness. The voltage to be applied was set at the same level as that in Example 1. As a result, the plasma display device in Example 4 showed a higher value than a reference value.

EXAMPLE 5

Example 5 is concerned with the plasma display device according to the fifth aspect of the present invention. In the plasma display device of Example 5, the dielectric material layer comprised a first dielectric material film constituted of a diamond-like carbon (DLC) layer, and a second dielectric material film composed of MgO and formed thereon.

The first panel 10 was produced by the following method. Procedures up to the formation of the bus electrode 13 were carried out in the same manner as in Example 1. Then, a diamond-like carbon layer (thickness 1 to 20 μm) was formed on the entire surface, for example, from a source gas containing carbon such as $CH_4$ by a high-frequency CVD method or a pyrolysis CVD method. Then, a 0.6 μm thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1.

The thus-produced plasma display devices for testing were measured for brightness. The voltage to be applied was set at the same level as that in Example 1. As a result, the plasma display device showed a higher value than a reference value even if the first dielectric material film 14 had a thickness of 20 μm. Further, as the thickness of the first dielectric material film decreased, the plasma display device exhibited a higher brightness value, and when the thickness of the dielectric material layer was particularly 15 μm or less, the plasma display device exhibited a far higher brightness value. Further, when the diamond-like carbon layer was replaced with a first dielectric material film constituted of a boron nitride layer or a chromium (III) oxide layer, similar results were obtained.

The first dielectric material film composed of boron nitride can be formed by a reactive RF sputtering method or a high-frequency CVD method. Otherwise, it can be formed by a method in which a paste containing boron nitride is screen-printed and the printed paste is calcined or sintered, or it can be formed by a spin coating method or a dipping method using a suspension containing boron nitride.

The first dielectric material film composed of chromium (III) oxide can be formed by a method in which a paste containing chromium (III) oxide is screen-printed and the printed paste is calcined or sintered, or it can be formed by a spin coating method or a dipping method using a suspension containing chromium (III) oxide. Otherwise, it can be formed by an RF sputtering method using chromium oxide (III) as a target and Ar gas and $O_2$ gas as a process gas, or a high-frequency CVD method.

EXAMPLE 6

Example 6 is concerned with the plasma display device according to the sixth aspect of the present invention. In the plasma display device of Example 6, the dielectric material layer comprised a first dielectric material film having a stacked structure constituted of a diamond-like carbon (DLC) layer and a silicon oxide layer, and a second dielectric material film composed of MgO and formed thereon.

The first panel 10 was produced by the following method. Procedures up to the formation of the bus electrode 13 were carried out in the same manner as in Example 1. Then, a diamond-like carbon layer (thickness 1 $\mu$m) was formed on the entire surface by a CVD method, and then a silicon oxide layer (thickness 2 $\mu$m) was formed thereon by a sputtering method. Then, a 0.6 $\mu$m thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1.

The thus-produced plasma display device for testing was measured for brightness. The voltage to be applied was set at the same level as that in Example 1. As a result, the plasma display device in Example 6 showed a higher value than a reference value. Further, when the diamond-like carbon layer was replaced with a first dielectric material film constituted of a boron nitride layer or a chromium (III) oxide layer, similar results were obtained. Further, a plasma display device was produced in the same manner as above except that the silicon oxide layer was replaced with an aluminum oxide layer, and the plasma display device was measured for brightness to show a higher value than a reference value. Moreover, a plasma display device was produced in the same manner as above except that the silicon oxide layer was replaced with a stacked structure constituted of a silicon oxide layer/aluminum oxide layer, and the plasma display device was measured for brightness to show a higher value than a reference value.

EXAMPLE 7

Example 7 is concerned with the plasma display device according to the seventh aspect of the present invention. In the plasma display device of Example 7, the dielectric material layer comprised a first dielectric material film having a stacked structure constituted of a diamond-like carbon (DLC) layer and an aluminum oxide layer, and a second dielectric material film composed of MgO and formed thereon.

The first panel 10 was produced by the following method. Procedures up to the formation of the bus electrode 13 were carried out in the same manner as in Example 1. Then, a diamond-like carbon layer (thickness 1 $\mu$m) was formed on the entire surface by a CVD method, and then an aluminum oxide layer (thickness 2 $\mu$m) was formed thereon by a sputtering method. Then, a 0.6 $\mu$m thick second dielectric material film (protective film) 15 composed of magnesium oxide (MgO) was formed on the first dielectric material film 14 by an electron beam deposition method. By the above steps, the first panel 10 was completed. The production of the second panel 20 and the assembly of the plasma display device were carried out in the same manner as in Example 1.

The thus-produced plasma display device for testing was measured for brightness. The voltage to be applied was set at the same level as that in Example 1. As a result, the plasma display device in Example 7 showed a higher value than a reference value. Further, when the diamond-like carbon layer was replaced with a first dielectric material film constituted of a boron nitride layer or a chromium (III) oxide layer, similar results were obtained. Further, a plasma display device was produced in the same manner as above except that the first dielectric material film had a stacked structure constituted of a diamond-like carbon layer and a silicon oxide layer or a stacked structure constituted of a diamond-like carbon layer, an aluminum oxide layer and a silicon oxide layer, similar results were obtained.

EXAMPLE 8

Figure 7:
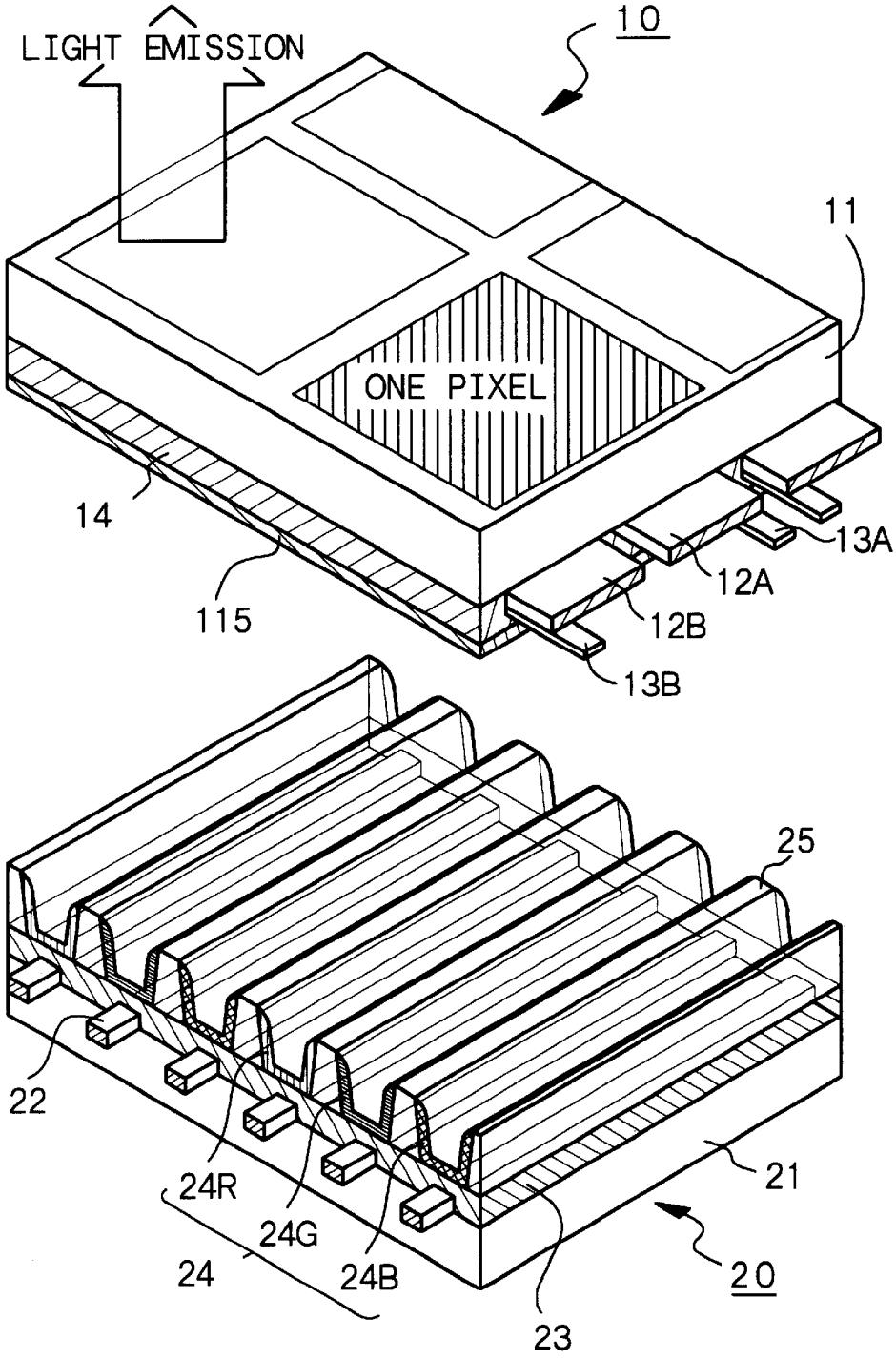
FIG. 7 is a schematic partial exploded perspective view of part of the plasma display device of Example 8.

Example 8 is concerned with the first constitution for the plasma display device according to the eighth aspect of the present invention. This plasma display device is a so-called tri-electrode type and comes under the surface discharge type. FIG. 7 shows a schematic exploded perspective view of part of the plasma display device of Example 8. The plasma display device has a first panel 10 and a second panel 20. The first panel (front panel) 10 comprises a first substrate 11 made, for example of glass; a first electrode group consisting of a plurality of first electrodes formed on the first substrate 11; a dielectric material layer which covers the first electrodes and comprises a first dielectric material layer 14A and a second dielectric material layer 14B; and a protective layer 115 composed of magnesium oxide (MgO) and formed on the dielectric material layer.

Figure 6:
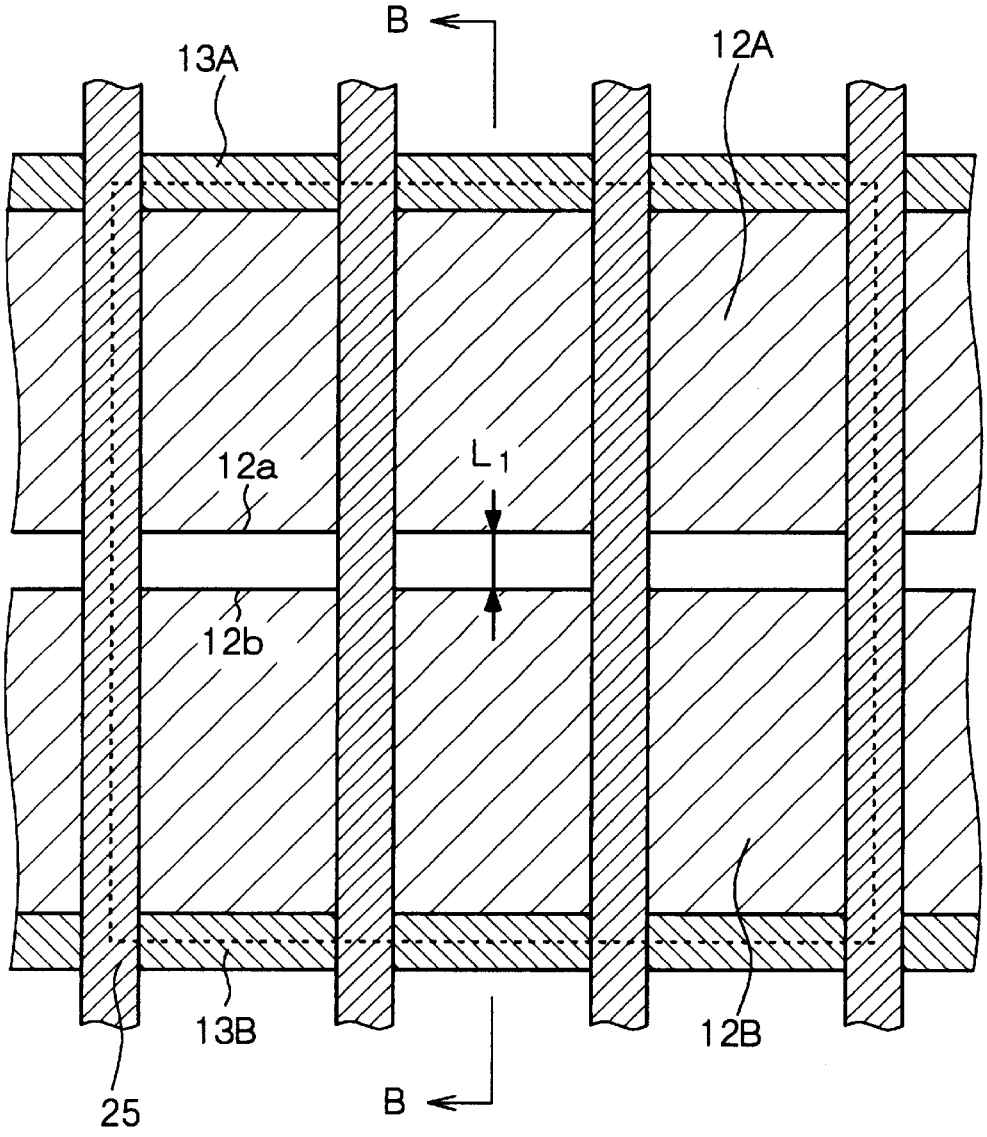
FIG. 6 is a schematic layout of sustain electrodes, bus electrodes and separation walls in a plasma display device of Example 8.

FIG. 6 schematically shows a layout of sustain electrodes 12A and 12B, bus electrodes 13A and 13B and separation walls 25 in the plasma display device shown in FIG. 7. A region surrounded by dotted lines corresponds to one pixel. FIG. 6 is provided with slanting lines for clearly showing each element. The outer form of each pixel is in the form of a square. Each pixel is divided into three sections (discharge cells) with the separation walls 25, and each section emits light in one color of three primary colors (R, G, B).

Each first electrode comprises a first bus electrode 13A, a first sustain electrode 12A being in contact with the first bus electrode 13A, a second bus electrode 13B extending in parallel with the first bus electrode 13A, and a second sustain electrode 12B being in contact with the second bus electrode 13B and facing the first sustain electrode 12A. The first sustain electrode 12A in the form of a stripe extends in parallel with the first bus electrode 13A in the form of a stripe, and the second sustain electrode 12B in the form of a stripe extends in the first direction in parallel with the second bus electrode 13B in the form of a stripe. Specifically, the first bus electrode 13A is formed on a portion of the first sustain electrode 12A adjacent to an edge portion of the first sustain electrode 12A. The second bus electrode 13B is formed on a portion of the second sustain electrode 12B adjacent to an edge portion of the second sustain electrode 12B. The first bus electrode 13A and the second bus electrode 13B are common to discharge cells neighboring to one another along the first direction, and the first sustain electrode 12A and the second sustain electrode 12B are common to the discharge cells neighboring to one another along the first direction. The bus electrodes 13A and 13B are provided for decreasing the impedance of the sustain electrodes 12A and 12B, and are composed of a material having a lower electric resistivity than the sustain electrodes 12A and 12B. The sustain electrodes 12A and 12B can be composed of a transparent electrically conductive material such as ITO. The bus electrodes 13A and 13B can be composed of a material having a lower electric resistivity than ITO, such as a chromium/copper/chromium stacked layer. The first and second bus electrodes 13A and 13B are preferably formed so as to have a line width which is as narrow as possible (for example, 50 $\mu$m wide) so long as desired brightness on a display screen (upper surface of the first substrate 11 in the drawing in this Example) is obtained. In this Example, the distance between the first sustain electrode 12A and the second sustain electrode 12B (distance $L_1$ between a side surface 12*a* and a side surface 12*b*) was determined to be less than $5\times10^{-5}$ m (for example, 20 $\mu$m). Glow discharge takes place between the first sustain electrode 12A and the second sustain electrode 12B.

Figure 8A:
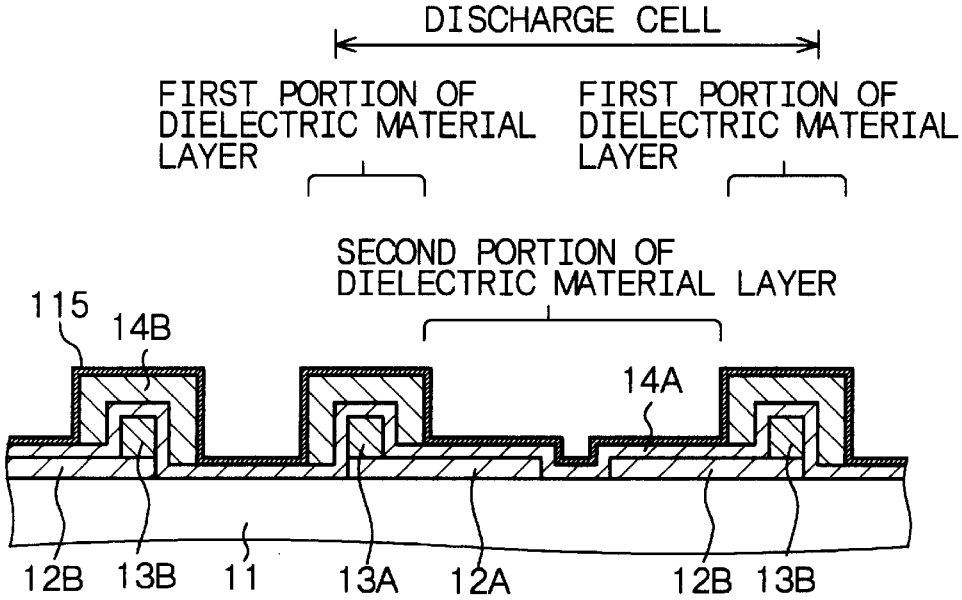
FIGS. 8A and 8B are schematic partial end views of a first panel taken by cutting the first panel similarly along arrows B—B in FIG. 6 in the plasma display device of Example 8 and its variant.

FIG. 8A shows a schematic partial end view taken by cutting the first panel 10 along arrows B—B in FIG. 6. The dielectric material layer comprises a first portion and a second portion. That is, the first portion of the dielectric material layer which portion covers the first bus electrode 13A and the second bus electrode 13B comprises the first dielectric material layer 14A and the second dielectric material layer 14B, and the second portion of the dielectric material layer which portion covers the first sustain electrode 12A and the second sustain electrode 12B comprises the first dielectric material layer 14A. The above first portion of the dielectric material layer is formed by stacking the first dielectric material layer 14A and the second dielectric material layer 14B in this order from the first substrate side. The first dielectric material layer 14A composed of silicon oxide ($SiO_2$) covers side surfaces and top surfaces of the first sustain electrode 12A and the second sustain electrode 12B. The second dielectric material layer 14B composed of a calcined or sintered product of a low-melting glass paste is formed on portions of the first dielectric material layer 14A which portions cover the first bus electrode 13A and the second bus electrode 13B. The first dielectric material layer 14A had a thickness of 3 $\mu$m on the top surface of the first sustain electrode 12A and on the top surface of the second sustain electrode 12B. Further, the second dielectric material layer 14B had a thickness of 10 $\mu$m on the top surface of the first bus electrode 13A and on the top surface of the second bus electrode 13B. The first dielectric material layer 14A is formed on the first substrate 11 between the first bus electrode 13A constituting the first electrodes and the second bus electrode 13B constituting the first electrode neighboring on the above first electrode.

A second panel (rear panel) 20 comprises a second substrate 21 made, for example, of glass; a second electrode group consisting of a plurality of second electrodes (also called address electrodes or data electrodes) 22 which are composed of silver or aluminum in the form of stripes and extend in the second direction while making a predetermined angle (for example, 90°) with the extending direction of the first electrodes; separation walls 25 formed between the neighboring second electrodes 22; and fluorescence layers 24 formed above the second electrodes 22. A dielectric substance layer 23 is formed on the second substrate 21 and on the second electrodes 22. The separation wall 25 is formed in a region which is on the dielectric substance layer 23 and between the neighboring second electrodes 22, and the separation wall 25 extends in parallel with the second electrodes 22. The fluorescence layer 24 is formed on the dielectric substance layer 23 and also formed so as to cover side walls of the separation walls 25. The fluorescence layer 24 is constituted of a red fluorescence layer 24R, a green fluorescence layer 24G and a blue fluorescence layer 24B, and the fluorescence layers 24R, 24G and 24B which emit light of three primary colors form one set and are formed on the second electrode 22 in a predetermined order. The second electrode 22 contribute to initiating the glow discharge together with the first and second sustain electrodes 12A and 12B and also contributes to improving the brightness of a display screen by reflecting light emitted from the fluorescence layers 24 toward the display screen side.

FIG. 7 shows a schematic exploded perspective view, and in an actual embodiment, top portions of the separation walls 25 on the second panel side are in contact with the protective layer 115 on the first panel side. The first panel 10 and the second panel 20 are arranged and bonded to each other through a seal layer (not shown) in their circumferential portions such that the protective layer 115 and the fluorescence layer 24 are positioned to face each other. An overlapping region of a pair of the first bus electrodes 13A and 13B, a pair of the sustain electrodes 12A and 12B extending from these bus electrodes 13A and 13B and the second electrode 22 positioned between two separation walls 25 corresponds to a discharge cell. Further, an overlapping region of a pair of the first bus electrode 13A and the second bus electrode 13B, a pair of the first sustain electrode 12A and the second sustain electrode 12B and one set of the fluorescence layers 24R, 24G and 24B for three primary colors corresponds to one pixel. A space formed with the first panel 10 and the second panel 20 is charged, for example, with a Ne—Xe mixed gas (for example, Ne 50%—Xe 50%) having a pressure of $8\times10^4$ Pa (0.8 atmospheric pressure). That is, a space surrounded by neighboring separation walls 25, the fluorescence layer 24 and the protective layer 115 is charged with a rare gas and sealed.

One example of AC glow discharge operation of the above-constituted plasma display device will be explained below. First, a pulse voltage lower than a discharge initiating voltage $V_{bd}$ is applied to all of the first bus electrodes for a short period of time. Glow discharge thereby takes place to generate a wall charge in the first dielectric material layer near one of a pair of the sustain electrodes due to dielectric polarization, the wall charge is accumulated, and an apparent discharge initiating voltage decreases. Thereafter, while a voltage is applied to the second electrode (address electrode) 22, a voltage is applied to one of a pair of the bus electrodes included in a discharge cell which is allowed not to display, whereby glow discharge is caused between the second electrode 22 and one of a pair of the sustain electrodes, to erase the accumulated wall charge. This erasing discharge is consecutively carried out in the second electrodes 22. Meanwhile, no voltage is applied to one of a pair of the bus electrodes included in a discharge cell which is allowed to display, whereby the accumulated wall charge is retained. Then, a predetermined pulse voltage is applied between all of pairs of the bus electrodes 13A and 13B. As a result, in a discharge cell where the the wall charge is accumulated, glow discharge starts between a pair of the sustain electrodes 12A and 12B, and in the discharge cell, the fluorescence layer excited by irradiation with vacuum ultraviolet ray generated by glow discharge in the rare gas emits light in color characteristic of the kind of a fluorescence material. The phase of the discharge sustain voltage applied to one of the sustain electrodes and the phase of the discharge sustain voltage applied to the other sustain electrode deviate from each other by half a cycle, and the polarity of each sustain electrode is inverted according to the frequency of alternate current. The plasma display devices explained in Examples 1 to 7 also work on the basis of a similar principle.

Another example of the AC glow discharge operation of the above-structured plasma display device will be explained below. First, erasing discharge is carried out with regard to all of pixels for initializing all the pixels, and then discharge operation is carried out. The discharge operation is divided into an address period for which a wall charge is generated on the surface of the first dielectric material layer 14 by an initial discharge and a discharge sustain period for which the glow discharge is sustained. In the address period, a pulse voltage lower than the discharge initiating voltage $V_{bd}$ is applied to one of the selected bus electrodes and a selected second electrode 22 for a short period of time. A region where one of the pulse-applied bus electrodes and the pulse-applied second electrode 22 overlap is selected as a display pixel, and in the overlap region, a wall charge is generated on the surface of the dielectric material layer 14 due to dielectric polarization, whereby the wall charge is accumulated. In the succeeding discharge sustain period, a discharge sustain voltage $V_{SUS}$ lower than $V_{bd}$ is applied to a pair of the bus electrodes 13A and 13B. When the sum of the wall voltage $V_W$ induced by the wall charge and the discharge sustain voltage $V_{SUS}$ comes to be greater than the discharge initiating voltage $V_{bd}$, (i.e., when $V_w+V_{SUS}>V_{bd}$), glow discharge is initiated. The phase of the discharge sustain voltages $V_{SUS}$ applied to one of the bus electrodes and the phase of the discharge sustain voltages $V_{SUS}$ applied to the other of the bus electrodes deviate from each other by half a cycle, and the polarity of each electrode is inverted according to the frequency of alternate current. The plasma display devices explained in Examples 1 to 7 also work on the basis of a similar principle.

In a pixel where the AC glow discharge is sustained, the fluorescent layers 24 are excited by irradiation with vacuum ultraviolet ray radiated due to the excitation of the rare gas in the space, and they emilt light having colors characteristic of kinds of fluorescent materials.

The method for producing the plasma display device of Example 8 will be outlined below.

The first panel 10 can be produced as follows. First, an ITO layer is formed on the entire surface of the first substrate 10, for example, by a sputtering method, and the ITO layer is patterned in the form of stripes by photolithography and an etching method, to form the first and second sustain electrodes 12A and 12B. Then, a chromium/copper chromium stacked film is formed on the entire surface by a sputtering method, and the chromium/copper chromium stacked film is patterned by photolithography and an etching method, to form the first and second bus electrodes 13A and 13B.

Then, the first electrode (12A, 13A, 12B, 13B) is covered with the first dielectric material layer 14A, and then, the second dielectric material layer 14B is formed on a portion of the first dielectric material layer 14A above the first bus electrode 13A and the second bus electrode 13B. Specifically, the first dielectric material layer 14A which is composed of $SiO_2$ and has a thickness of 3 $\mu$m is formed on the entire surface by a CVD method. Then, a low-melting glass paste in the form of stripes is formed on the first dielectric material layer 14A by a screen printing method, and the low-melting glass paste is temporarily calcined or sintered and fully calcined or sintered to obtain the second dielectric material layer 14B composed of a calcined or sintered product of the low-melting glass paste. Then, the protective layer 115 which has a thickness of approximately 0.6 $\mu$m and is composed of MgO is formed on the entire surface by an electron beam deposition method. By the above steps, the first panel 10 can be completed.

The second panel 20 can be produced as follows. First, a silver paste is printed on the second substrate 21 to be in the form of stripes, and it is calcined or sintered to form the second electrodes 22. Then, a low-melting glass paste layer is formed on the entire surface by a screen printing method, and the low-melting glass paste layer is calcined or sintered to form the dielectric substance layer 23. Then, a low-melting glass paste is printed on the dielectric substance layer 23 above a region between the neighboring second electrodes 22, for example, by a screen printing method, and it is calcined or sintered to form the separation walls 25. The separation walls can have a height, for example, from $1\times10^{-4}$ m (100 $\mu$m) to $2\times10^{-4}$ m (200 $\mu$m). Then, fluorescence material slurries of three primary colors are consecutively printed, and they are calcined or sintered to form the fluorescence layers 24R, 24G and 24B. By the above steps, the second panel 20 can be completed.

Then, the plasma display device is assembled. First, a seal layer (not shown) is formed in a circumferential portion of the second panel 20, for example, by a screen printing method. Then, the first panel 10 and the second panel 20 are bonded to each other, and then the seal layer is calcined or sintered to cure the seal layer. Then, a space formed between the first panel 10 and the second panel 20 is vacuumed and then charged with a Ne—Xe mixed gas (for example, Ne 50%—Xe 50%) having a pressure of $8\times10^4$ Pa (0.8 atmospheric pressure), and the space is sealed to complete the plasma display device. If the first panel 10 and the second panel 20 are bonded to each other in a chamber filled with a Ne—Xe mixed gas having a pressure of $8\times10^4$ Pa (0.8 atmospheric pressure), the steps of vacuuming the space and charging the Ne—Xe mixed gas can be omitted.

Figure 8B:
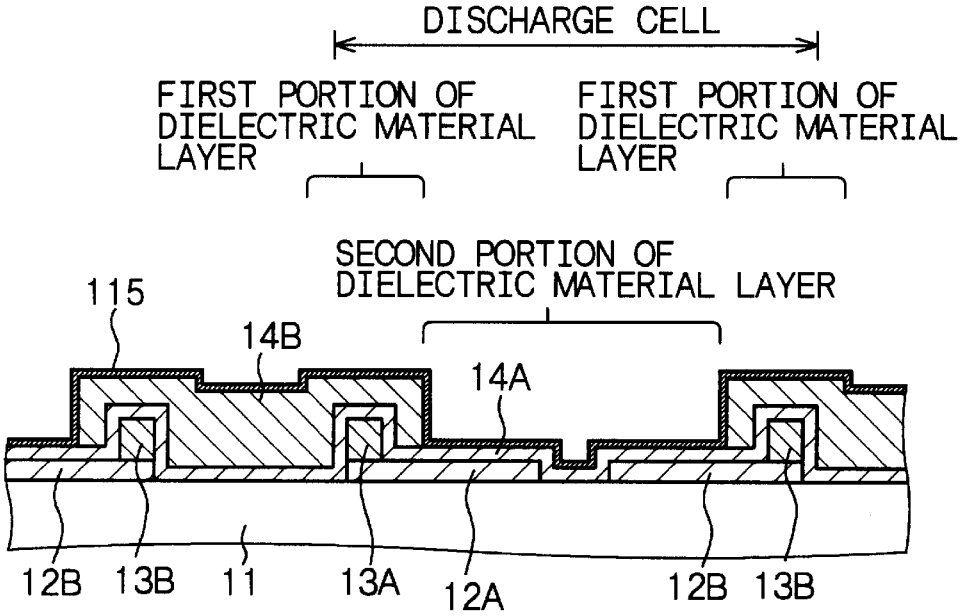

FIG. 8B shows a schematic partial end view of the first panel 10 taken by cutting the first panel 10 along arrows B—B in FIG. 6. As shown in FIG. 8B, the first dielectric material layer 14A and the second dielectric material layer 14B in this order from the first substrate side may be formed on the first substrate 11 between the first bus electrode 13A constituting the first electrode and the second bus electrode 13B constituting the first electrode neighboring on the above first electrode. The above constitution can be obtained by providing a low-melting glass paste with a proper pattern when the low-melting glass paste in the form of stripes is formed on the first dielectric material layer 14A by a screen printing method.

In embodiments shown in FIGS. 8A and 8B, the second dielectric material layer 14B may be also formed in regions of the first panel 10 which regions correspond to the separation walls 25 formed in the second panel 20. That is, the second dielectric material layer 14B can be formed in the form of a grille (lattice) as a plan form. In this case, specifically, the first electrode (12A, 13A, 12B, 13B), the first dielectric material layer 14A and the second dielectric material layer 14B are formed in the region of the first panel 10 which region corresponds to the separation wall 25 formed in the second panel 20. The above structure can reliably prevent a so-called optical crosstalk in which glow discharge has an influence on a neighboring discharge cell.

EXAMPLE 9

Figure 9A:
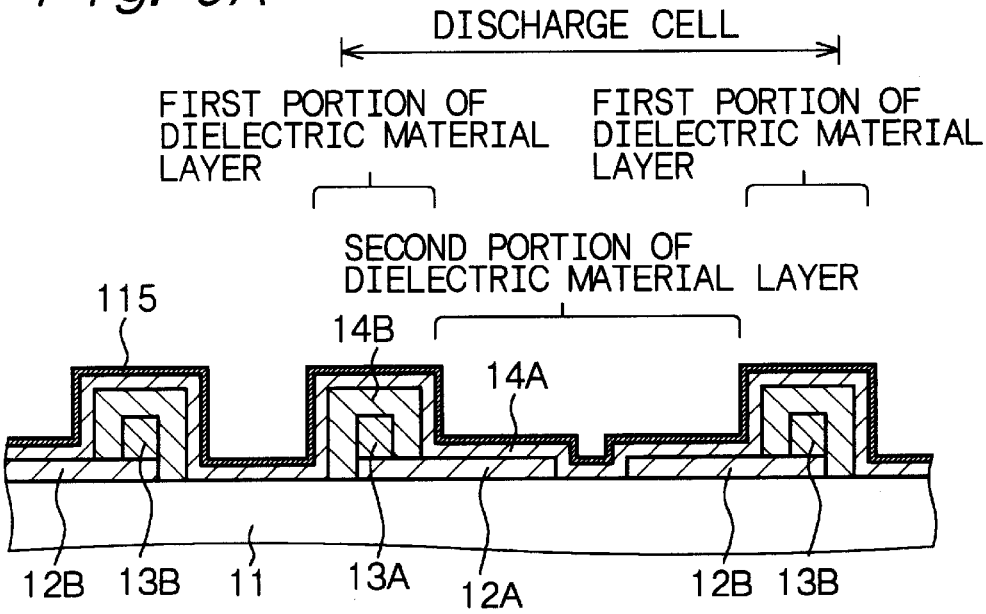
FIGS. 9A and 9B are schematic partial end views of a first panel taken by cutting the first panel similarly along arrows B—B in FIG. 6 in a plasma display device of Example 9 and its variant.
Figure 9B:
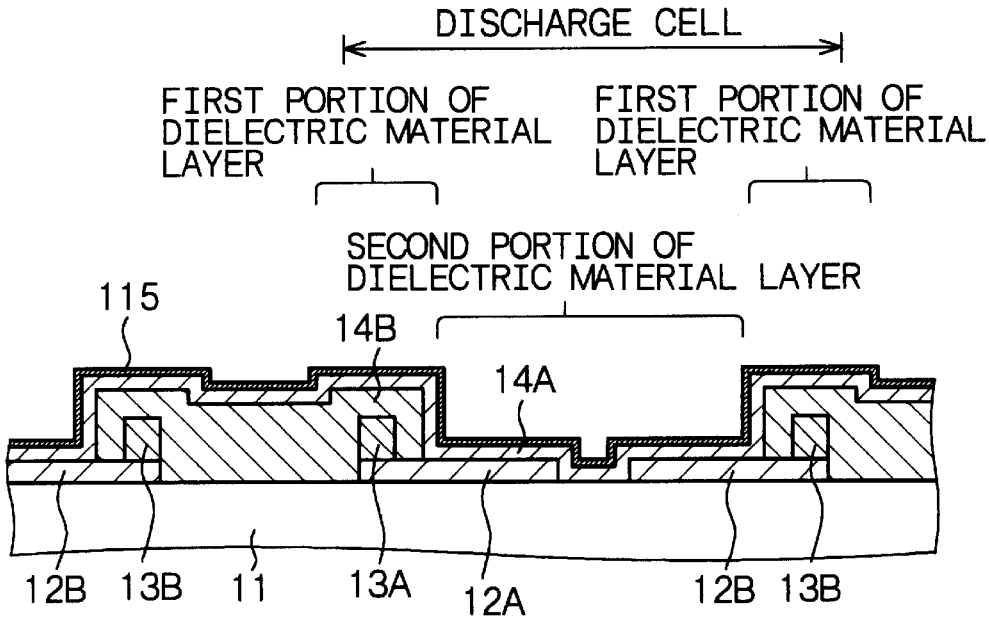

Example 9 is a variant of the plasma display device of Example 8. The plasma display device of Example 9 differs from the counterpart of Example 8 in that the first portion of the dielectric material layer is formed by stacking the second dielectric material layer 14B and the first dielectric material layer 14 in this order from the first substrate side, as is shown in FIGS. 9A and 9B which show schematic partial end views of the first panel 10 taken by cutting the first panel 10 along arrows B—B in FIG. 6. The plasma display device of Example 9 and the counterpart of Example 8 are structurally the same except for the above point.

In the plasma display device of Example 9, the second dielectric material layer 14B composed of a calcined or sintered product of a low-melting glass paste covers side surfaces and top surfaces of the first bus electrode 13A and the second bus electrode 13B. Further, the first dielectric material layer 14A composed of silicon oxide ($SiO_2$) is formed on the second dielectric material layer 14B covering the first bus electrode 13A and the second bus electrode 13B and on top surfaces and side surfaces of the first sustain electrode 12A and the second sustain electrode 12B. In an embodiment shown in FIG. 9A, the first dielectric material layer 14A is formed on the first substrate 11 between the first bus electrode 13A constituting the first electrode and the second bus electrode 13B constituting the first electrode neighboring on the above first electrode.

The constitution shown in FIG. 9A can be obtained by covering the first bus electrode 13A and the second bus electrode 13B with the second dielectric material layer 14B and then covering the first electrode with the first dielectric material layer 14A. Specifically, a low-melting glass paste is formed on the first and second bus electrodes 13A and 13*b* by a screen printing method to be in the form of stripes, and the low-melting glass paste is temporarily calcined or sintered and fully calcined or sintered to obtain the second dielectric material layer 14B composed of a calcined or sintered product of the low-melting glass paste. Then, the first dielectric material layer 14A which is composed of $SiO_2$ and has a thickness of 3 $\mu$m can be formed on the entire surface by a CVD method.

As shown in FIG. 9B, the second dielectric material layer 14B and the first dielectric material layer 14A in this order from the first substrate side may be formed on the first substrate 11 between the first bus electrode 13A constituting the first electrode and the second bus electrode 13B constituting the first electrode neighboring on the above first electrode. The above constitution can be obtained by providing a low-melting glass paste with a proper pattern when the low-melting glass paste in the form of stripes is formed on the first and second bus electrodes 13A and 13B by a screen printing method.

In embodiments shown in FIGS. 9A and 9B, the second dielectric material layer 14B may be also formed in regions of the first panel 10 which regions correspond to the separation walls 25 formed in the second panel 20. That is, the second dielectric material layer 14B can be formed in the form of a grille (lattice) as a plan form. In this case, specifically, the first electrode (12A, 13A, 12B, 13B), the second dielectric material layer 14B and the first dielectric material layer 14A are formed in the region of the first panel 10 which region corresponds to the separation wall 25 formed in the second panel 20. The above structure can reliably prevent a so-called optical crosstalk in which glow discharge has an influence on a neighboring discharge cell.

EXAMPLE 10

Figure 10:
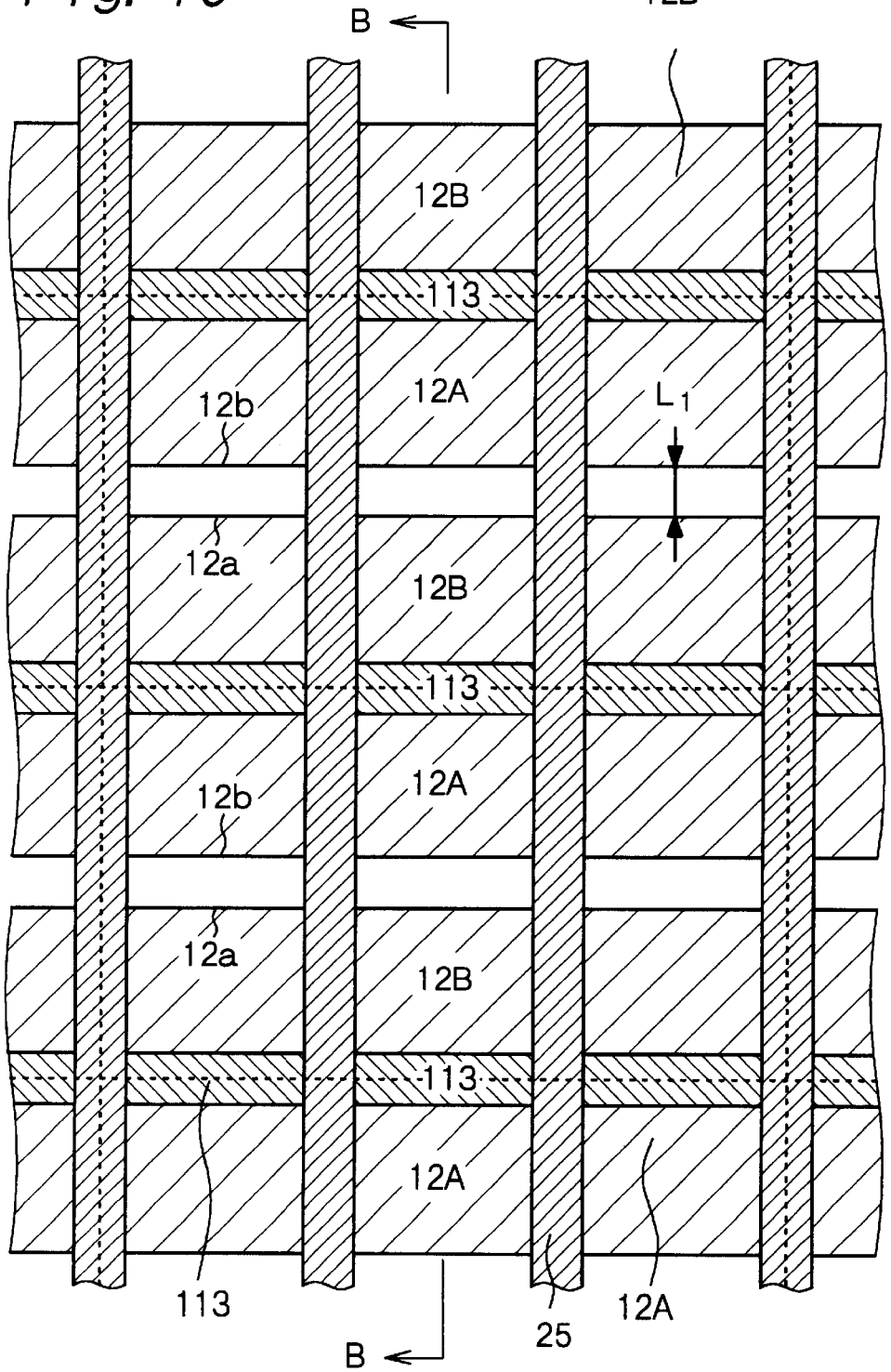
FIG. 10 is a schematic layout of sustain electrodes, bus electrodes and separation walls in a plasma display device of Example 10.
Figure 11:
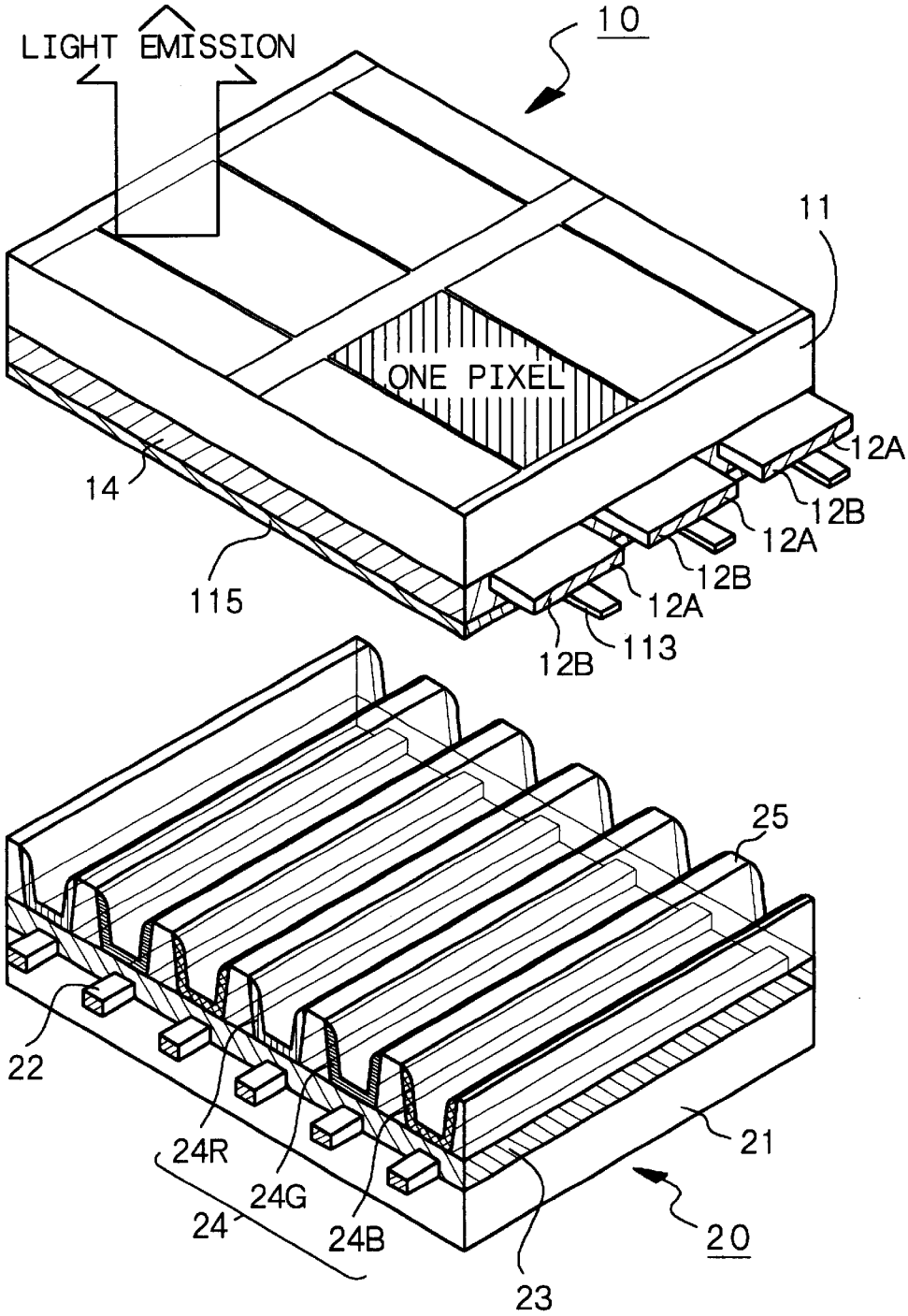
FIG. 11 is a schematic exploded perspective view of part of the plasma display device of Example 10.

Example 10 is concerned with the second constitution for the plasma display device according to the eighth aspect of the present invention. This plasma display device is also a so-called tri-electrode type and comes under the surface discharge type. The plasma display device of Example 10 is also called an ALIS (Alternate Lighting of Surfaces) type plasma display device. FIG. 10 schematically shows a layout of sustain electrodes 12A and 12B, bus electrodes 13A and 13B and separation walls 25 in the plasma display device of Example 10. A region surrounded by dotted lines corresponds to one pixel. FIG. 10 is provided with slanting lines for clearly showing each element. While FIG. 10 shows a pixel in the form of a rectangle, each pixel actually has the outer form of a general square. Each pixel is divided into three sections (discharge cells) with the separation walls 25, and each section emits light in one of three primary colors (R, G, B). FIG. 11 shows a schematic exploded perspective view of part of the plasma display device of Example 10. This plasma display device has a first panel 10 and a second panel 20. The first panel (front panel) 10 comprises a first substrate 11 made, for example, of glass; a first electrode group consisting of a plurality of first electrodes formed on the first substrate 11; a dielectric material layer which covers the first electrodes and comprises a first dielectric material layer 14A and a second dielectric material layer 14B; and a protective layer 115 composed of magnesium oxide (MgO) and formed on the dielectric material layer.

In the plasma display device of Example 10, the first bus electrode constituting the first electrode and the second bus electrode constituting the first electrode neighboring on the above first electrode are constituted of one common element. That is, these bus electrodes comprise one electrically conductive material layer in the form of a stripe (to be referred to as "bus-electrode-constituting conductive material layer"). The first bus electrode and the second bus electrode which are common as described above are shown as a common bus electrode 113. Each first electrode comprises the first bus electrode (common bus electrode) 113, a first sustain electrode 12A being in contact with the common bus electrode 113, a second bus electrode (neighboring common bus electrode 113) extending in parallel with the above common bus electrode 113 and a second sustain electrode 12B being in contact with the above common bus electrode 113 and facing the first sustain electrode 12A. The first sustain electrode 12A constituting the first electrodes and the second sustain electrode 12B constituting the first electrodes neighboring on the above first electrodes are constituted of one electrically conductive material layer (to be referred to as "sustain-electrode-constituting conductive material layer") in the form of a stripe. The common bus electrode 113 is formed in a central portion of the sustain-electrode-constituting conductive material layer. The bus-electrode-constituting conductive material layer and the sustain-electrode-constituting conductive material layer extend in a first direction. Further, the common bus electrode 113 is common to discharge cells neighboring along the first direction, and the first sustain electrode 12A and the second sustain electrode 12B are also common to the discharge cells neighboring along the first direction. The bus-electrode-constituting conductive material layer and the sustain-electrode-constituting conductive material layer can be formed, for example, of a chromium/copper/chromium stacked layer and ITO like Example 8, respectively. The distance between the first sustain electrode 12A and the second sustain electrode 12B (distance $L_1$ between a side surface 12*a* and a side surface 12*b*) was determined to be less than $5\times10^{-5}$ m (for example, 20 $\mu$m). Glow discharge takes place between the first sustain electrode 12A and the second sustain electrode 12B.

Figure 12A:
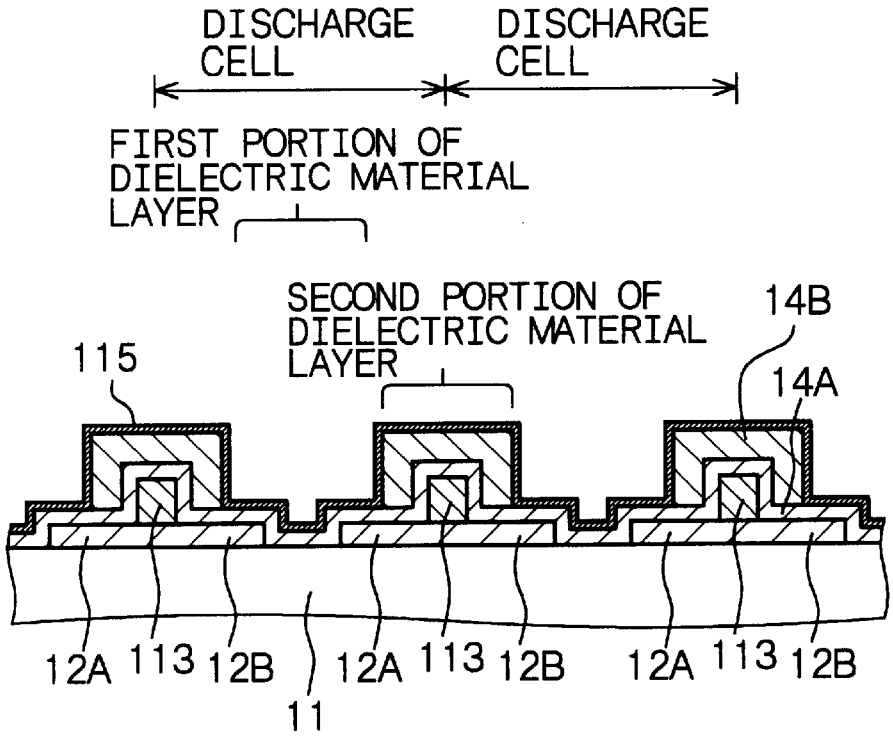
FIGS. 12A and 12B are schematic partial end views of a first panel in the plasma display device of Example 10.

FIG. 12A shows a schematic partial end view of the first panel 10 taken by cutting the first panel 10 along arrows B—B in FIG. 10. The dielectric material layer comprises a first portion and a second portion. That is, the first portion of the dielectric material layer which portion covers the common bus electrode 113 comprises a first dielectric material layer 14A and a second dielectric material layer 14B, and a second portion of the dielectric material layer which portion covers the first sustain electrode 12A and the second sustain electrode 12B comprises the first dielectric material layer 14A. In the above first portion of the dielectric material layer, the first dielectric material layer 14A and the second dielectric material layer 14B are stacked in this order from the first substrate side. The first dielectric material layer 14A composed of silicon oxide ($SiO_2$) covers side surfaces and top surfaces of the first sustain electrode 12A and the second sustain electrode 12B. The second dielectric material layer 14B composed of a calcined or sintered product of a low-melting glass paste is formed on a portion of the first dielectric material layer 14A which portion covers the common bus electrode 113. The first dielectric material layer 14A on the top surface of the first sustain electrode 12A and on the top surface of the second sustain electrode 12B has a thickness of 3 $\mu$m. The second dielectric material layer 14B on the top surface of the common bus electrode 113 has a thickness of 10 $\mu$m.

The second panel 20 and the other constitution of the plasma display device can be the same as those in Example 8, so that detailed explanations thereof are omitted. An overlapping portion of a pair of the common sustain electrodes 113, a pair of sustain electrodes 12A and 12B extending from the above common bus electrodes 113 and the second electrode 22 positioned between two separation walls 25 corresponds to a discharge cell. An overlapping portion of a pair of the common bus electrodes 113, a pair of the first sustain electrode 12A and the second sustain electrode 12B and one set of fluorescence layers 24R, 24G and 24B of three primary colors corresponds to one pixel.

The plasma display device of Example 10 can be produced in the same manner as in the plasma display device production method explained in Example 8, so that detailed explanations thereof are omitted.

In driving the thus-constituted plasma display device, the sustain-electrode-constituting conductive material layer in the form of one line corresponds to two upper and lower sustain electrodes. And, odd-number display liens and even-number display lines are divided to separate fields and displayed, and this is alternately repeated, whereby a full screen of the plasma display device is displayed. For more detailed disclosures, JP-A-9-160525 can be referred to.

Figure 12B:
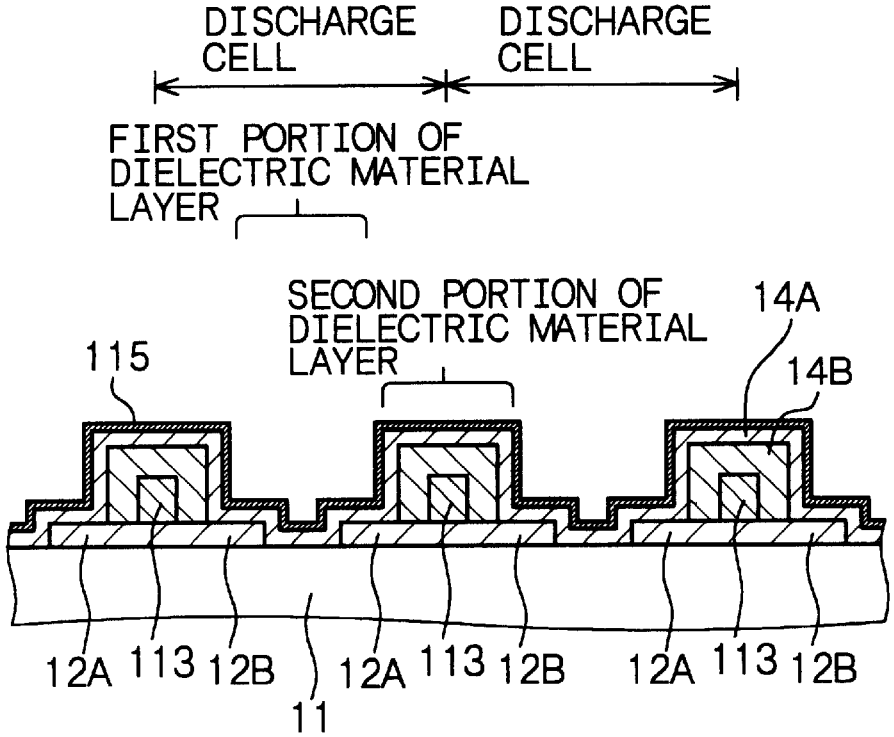

Like Example 9, there may be employed a constitution in which the first portion of the dielectric material layer is formed by stacking the second dielectric material layer 14B and the first dielectric material layer 14A in this order from the first substrate 11 side. FIG. 12B shows a schematic partial end view of the first panel of the above-constituted plasma display device taken by cutting the first panel along a line B—B in FIG. 10. In this plasma display device, the second dielectric material layer 14B composed of a calcined or sintered product of a low-melting glass paste covers the side surfaces and the top surface of the common bus electrode 113. Further, the first dielectric material layer 14A composed of silicon oxide ($SiO_2$) is formed on the second dielectric material layer 14B covering the common bus electrode 113 and on top surfaces and side surfaces of the first sustain electrode 12A and the second sustain electrode 12B.

The constitution shown in FIG. 12B can be obtained by covering the common bus electrode 113 with the second dielectric material layer 14B and then covering the first electrodes with the first dielectric material layer 14A. Specially, the second dielectric material layer 14B composed of a calcined or sintered product of a low-melting glass paste can be obtained by forming a low-melting glass paste on the common bus electrode 113 by a screen printing method in the form of a stripe, temporarily calcining or sintering the low-melting glass paste and then fully calcining or sintering it. Then, the first dielectric material layer 14A which is composed of $SiO_2$ and has a thickness of 3 $\mu$m can be formed on the entire surface by a CVD method.

In embodiments shown in FIGS. 12A and 12B, the second dielectric material layer 14B can be formed in regions of the first panel 10 which regions correspond to the separation walls 25 formed in the second panel 20. That is, the second dielectric material layer 14B can be formed in the form of a grille (lattice) as a plan form. In this case, specifically, the first electrodes (12A, 12B, 113), the second dielectric material layer 14B and the first dielectric material layer 14A are formed in the region of the first panel 10 which region corresponds to the separation wall 25 formed in the second panel 20. The above structure can reliably prevent a so-called optical crosstalk in which glow discharge has an influence on a neighboring discharge cell.

The present invention has been explained with reference to Examples hereinabove, while the present invention shall not be limited thereto. The structures and constitutions of the plasma display devices, the materials, the dimensions and the production methods used or explained in Examples are provided for illustration purposes and can be changed or altered as required. The methods of forming the dielectric material layers (first dielectric material film, second dielectric material film, first dielectric material layer and second dielectric material layer) in Examples are shown as examples and are dependent upon materials to be used for constituting the dielectric material layers, and the dielectric material layers can be formed by methods suitable for materials to be used for constituting the dielectric material layers. For example, the dielectric material layer from a water glass or a suspension of glass powders can be formed on the first substrate and the sustain electrodes by a spin coating method or a screen printing method.

In the plasma display device according to the first to seventh aspects of the present invention, a transmission type plasma display device in which light emission from fluorescence layers is observed through the second panel can be applied to the present invention. Examples have employed a constitution in which the plasma display device comprises a pair of the sustain electrodes extending in parallel with each other. However, this constitution can be replaced by a constitution in which a pair of bus electrodes extend in a first direction, one sustain electrode extends in a second direction from one bus electrode short of the other bus electrode between a pair of the bus electrodes and the other sustain electrode extends in the second direction from the other bus electrode short of the one bus electrode between a pair of the bus electrodes. There may be employed a constitution in which, of a pair of the sustain electrodes, one sustain electrode extending in the first direction is formed on the first substrate and the other sustain electrode is formed on an upper portion of side wall of the separation wall so as to be in parallel with the address electrode. The plasma display device of the present invention may be a bi-electrode type plasma display device. Further, the address electrode may be formed on the first substrate. The thus-structured plasma display device can comprise, for example, a pair of sustain electrodes extending in the first direction and an address electrode formed near and along one of a pair of the sustain electrodes (provided that the address electrode along one of a pair of the sustain electrodes has a length which length does not exceed the length of a discharge cell in the first direction). Short-circuiting to the sustain electrode is prevented by a structure in which a wiring for the address electrode is formed through an insulating layer, the wiring extends in the second direction, and the wiring for the address electrode and the address electrode are electrically connected or the address electrode extends from the wiring for the address electrode.

Figure 13A:
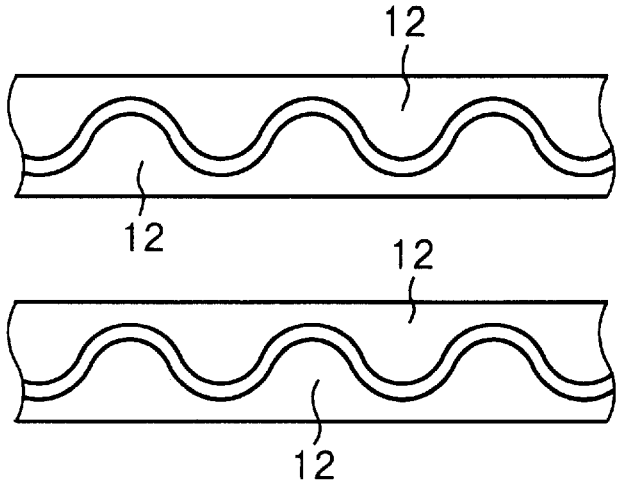
FIGS. 13A, 13B and 13C are schematic partial plan views of pairs of sustain electrodes of which the facing edge portions have patterns bent or curved in the width direction of the sustain electrodes in the plasma display device of the present invention.
Figure 13B:
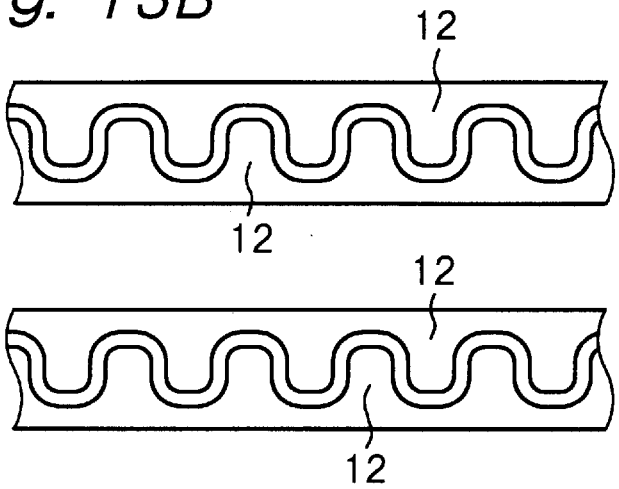
Figure 13C:
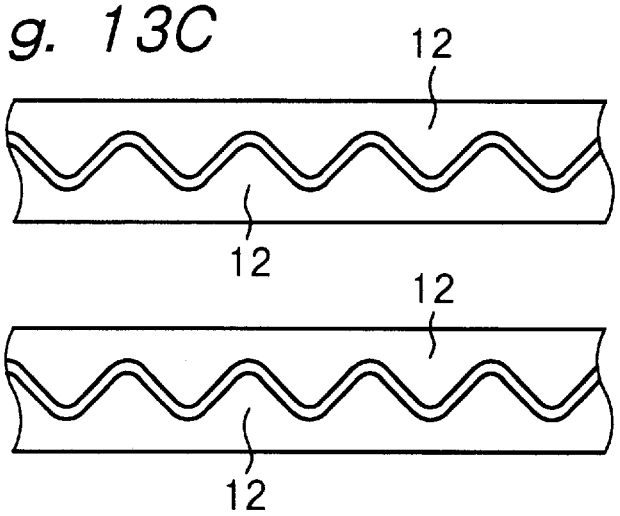

In Examples 1 to 7, the gap formed by edge portions of a pair of the facing sustain electrodes has the form of a straight line. However, the gap formed by edge portions of a pair of the facing sustain electrodes may have the form of a pattern bent or curved in the width direction of the sustain electrodes (for example, a combination of any forms such as the forms of a "dogleg", "S-letter" or arc). In such a constitution, the length of each of the edge portions of a pair of the facing sustain electrodes can be increased, so that the discharge efficiency can be improved. FIGS. 13A, 13B and 13C show schematic partial plan views of two sets of a pair of sustain electrodes having the above structures.

In Examples 8 to 10, the first sustain electrode 12A and the second sustain electrode 12B may be formed between a pair of the separation walls instead of being common to the discharge cells neighboring along the first direction (that is, they may be formed per discharge cell).

Figure 14:
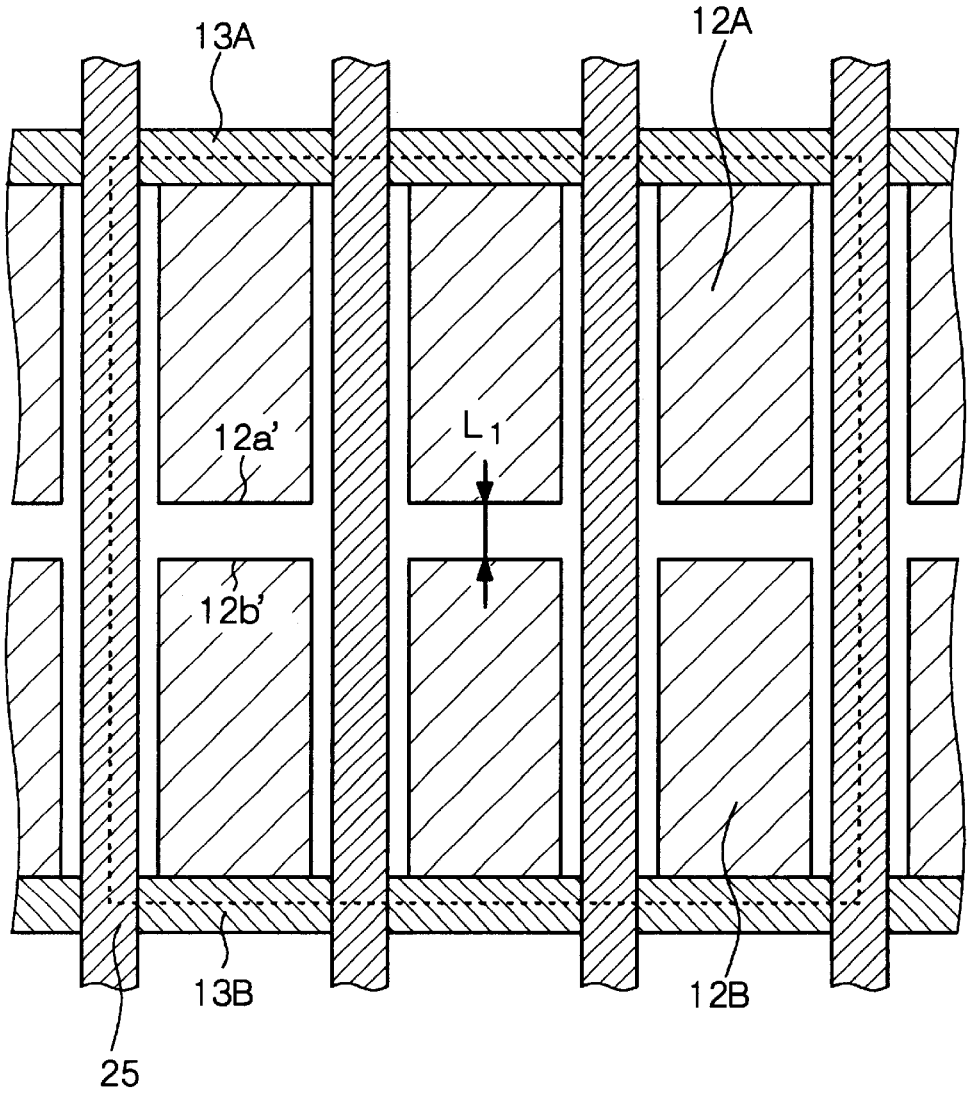
FIG. 14 is a schematic drawing of a variant of the layout of the sustain electrodes, the bus electrodes and the separation walls in the plasma display device of the present invention.
Figure 15:
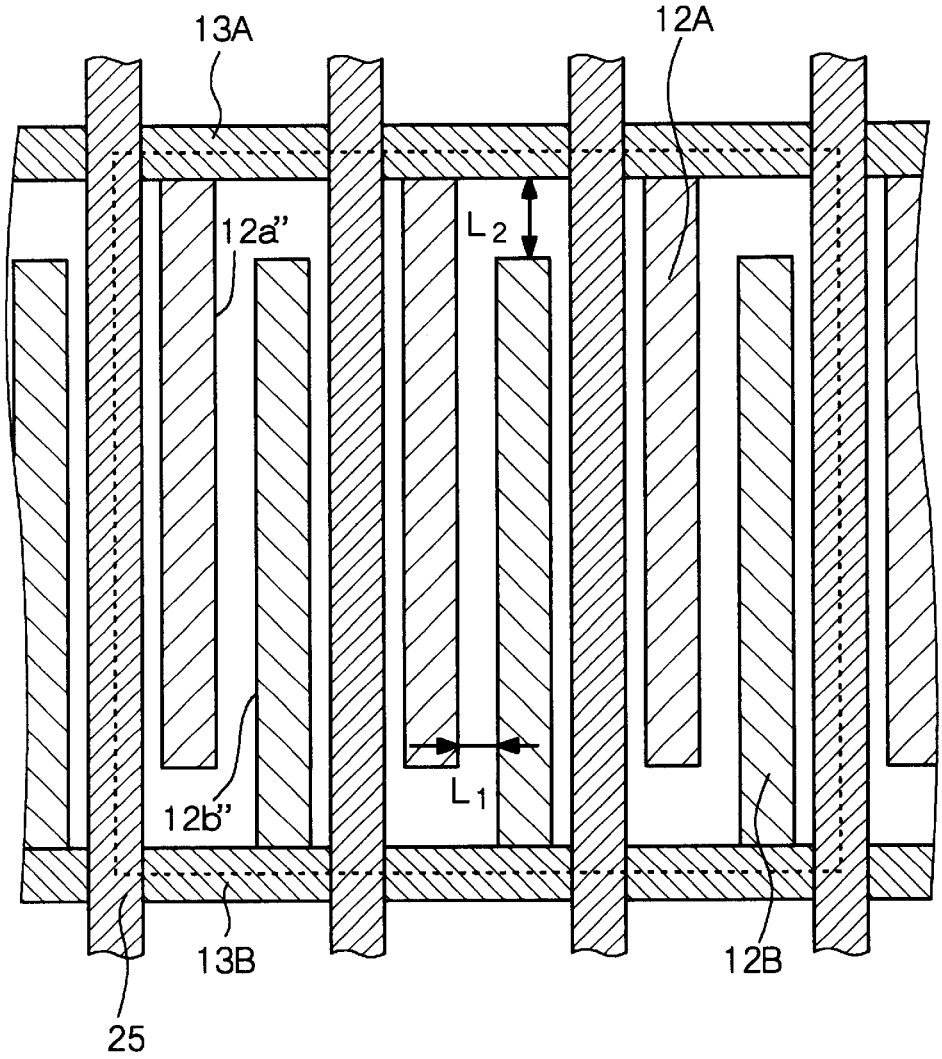
FIG. 15 is a schematic drawing of another variant of the layout of the sustain electrodes, the bus electrodes and the separation walls in the plasma display device of the present invention.
Figure 16:
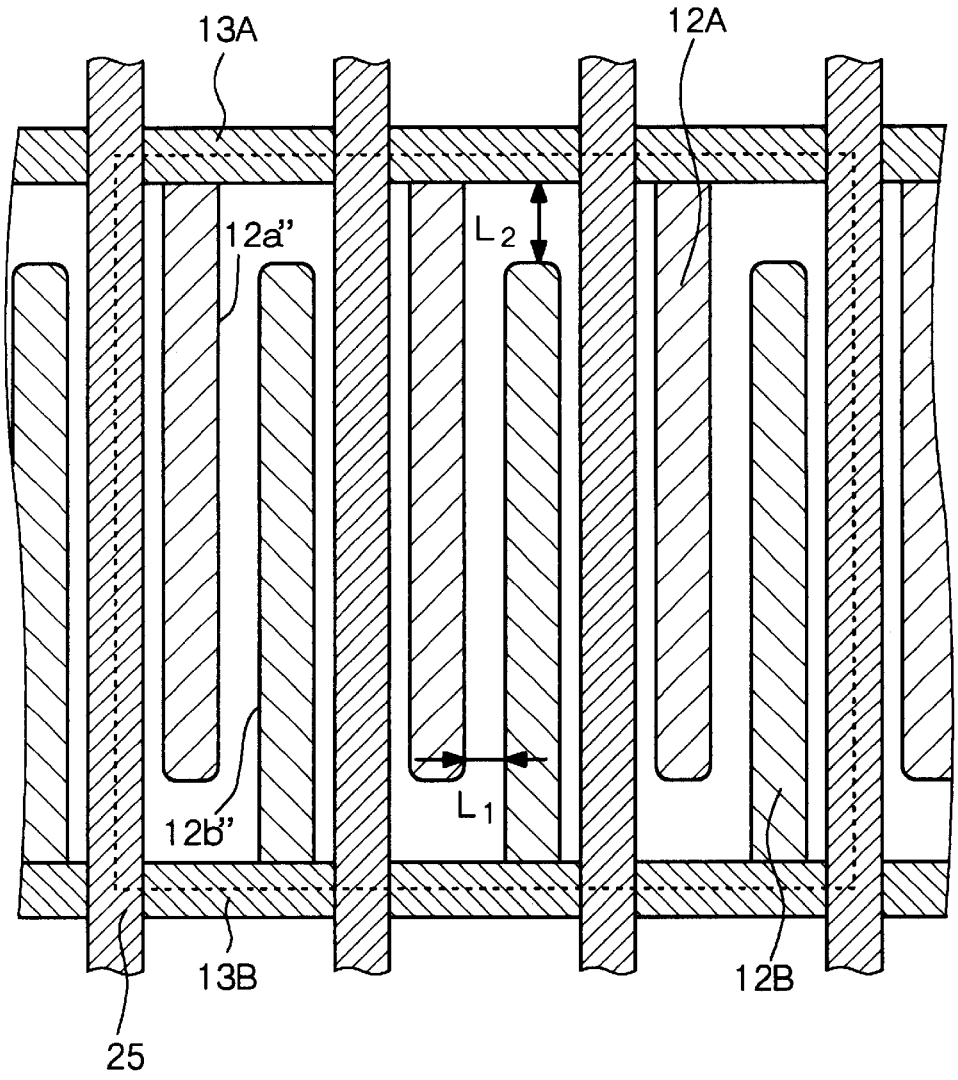
FIG. 16 is a schematic drawing of still another variant of the layout of the sustain electrodes, the bus electrodes and the separation walls in the plasma display device of the present invention.

FIGS. 14 to 16 schematically show specific layouts of the sustain electrodes, the bus electrodes and the separation walls in Examples 1 to 10, in which reference numerals 12A and 12B show the sustain electrodes and reference numerals 13A and 13B show the bus electrodes. In an embodiment shown in FIG. 14, the first sustain electrode 12A extends from the first bus electrode 13A toward the second bus electrode 13B in parallel with the second direction and extends between the separation walls 25, the second sustain electrode 12B extends from the second bus electrode 13B toward the first bus electrode 13A in parallel with the second direction and extends between the separation walls 25, and glow discharge takes place between a top end portion 12*a*' of the first sustain electrode 12A and a top end portion 12*b*' of the second sustain electrode 12B. The top end portion 12*a*' of the first sustain electrode 12A and the top end portion 12*b*' of the second sustain electrode 12B may be linear or may be in a zigzag form (for example, a combination of "dogleg" forms, a combination of "S" letters, a combination of arc forms or a combination any curved forms). In the above constitution, the area of the sustain electrodes can be decreased, and as a result, the electrode capacitance can be decreased, so that the power consumption can be decreased.

Figure 17:
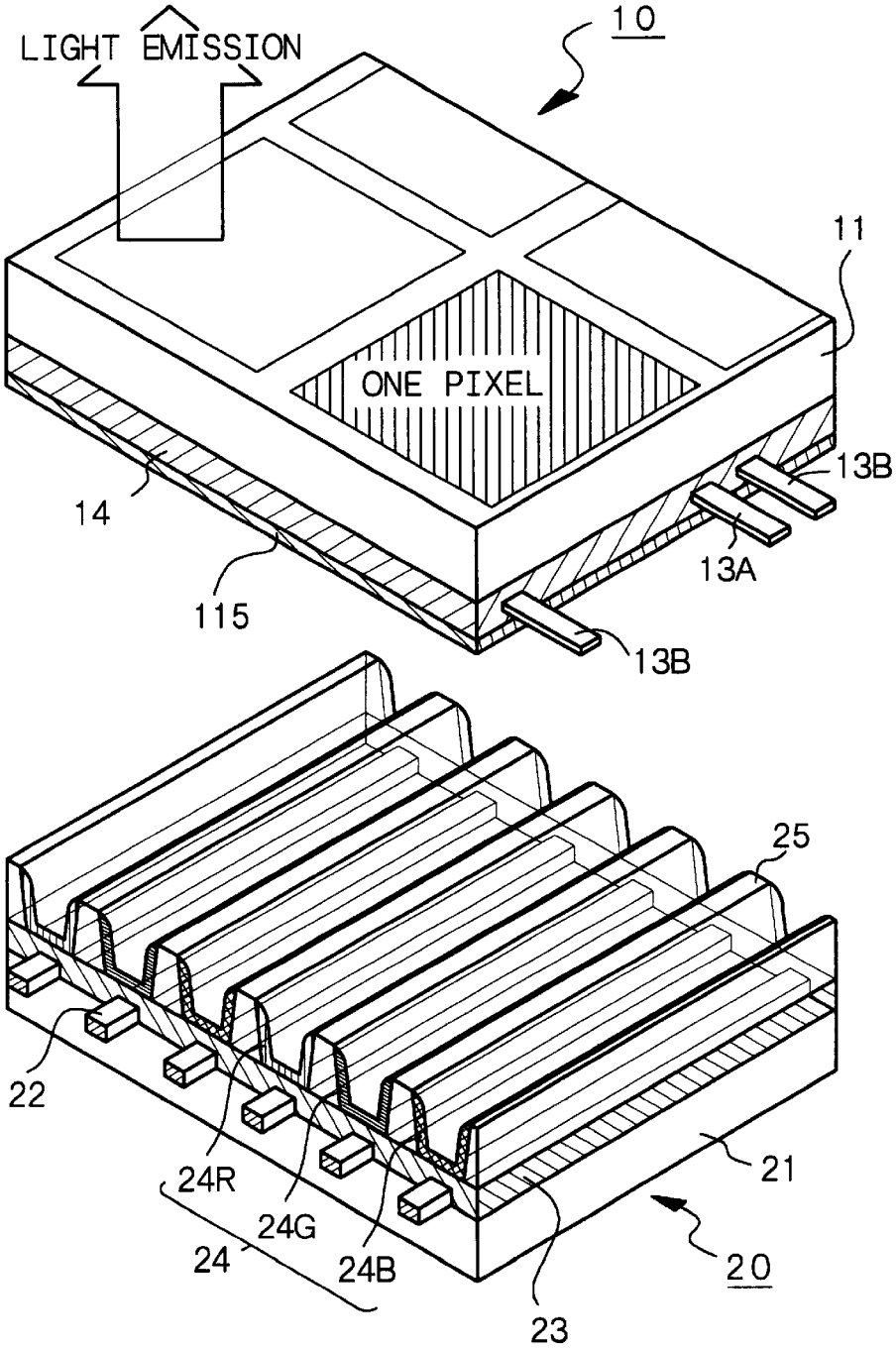
FIG. 17 is a schematic exploded perspective view of part of a plasma display device having the layout shown in FIG. 15.

Alternatively, FIG. 15 schematically shows a layout of the sustain electrodes 12A and 12B, the bus electrodes 13A and 13B and the separation walls 25, and FIG. 17 shows a schematic exploded perspective view of part of these. As shown in these drawings, each first electrode may be constituted of (A) a first bus electrode 13A extending in a first direction, (B) a second bus electrode 13B extending in parallel with the first bus electrode 13A, (C) a first sustain electrode 12A which extends between the separation walls 25 and extends from the first bus electrode 13A toward the second bus electrode 13B in parallel with a second direction but short of the second bus electrode 13B and (D) a second sustain electrode 12B which extends between the separation walls 25 and extends from the second bus electrode 13B toward the first bus electrode 13A in parallel with the second direction but short of the first bus electrode 13A while facing the first sustain electrode 12A. And, Glow discharge takes place between a portion 12*a*" of the first sustain electrode 12A facing the second sustain electrode 12B and a portion 12*b*" of the second sustain electrode 12B facing the first sustain electrode 12A.

In a region between a pair of the separation walls 25, the number of the first sustain electrode(s) 12A extending from the first bus electrode 13A is taken as $N_1$, and the number of the second sustain electrode(s) 12B extending from the second bus electrode 13B is taken as $N_2$. In this case, there may be employed a condition that $N_1=N_2=1$. When n is an integer of 1 or more, there may be employed a condition wherein $N_1=2n-1$ and $N_2=2n$, or $N_1=2n$ and $N_2=2n-1$, or a condition that $N_1=N_2=2n$.

In the constitution of the plasma display device shown in FIG. 15, the first sustain electrode 12A and the second sustain electrode 12B extend while facing each other. The distance between the first sustain electrode 12A and the second sustain electrode 12B is preferably a predetermined distance, more preferably a constant distance. The plan form of each of the first sustain electrode 12A and the second sustain electrode 12B may be generally rectangular (that is, the first sustain electrode 12A and the second sustain electrode 12B may have a linear form) (see FIG. 15), or they may be in a zigzag form (for example, a combination of "dogleg" forms, a combination of "S" letters, a combination of arc forms or a combination any curved forms). In the latter case, for preventing abnormal discharge between the first sustain electrode 12A and the second sustain electrode 12B, preferably, the facing portions 12*a*" and 12*b*" of the first sustain electrode 12A and the second sustain electrode 12B have no angular portion. For preventing abnormal discharge from corners of top end of the first sustain electrode 12A or corners of top end of the second sustain electrode 12B, preferably, the top end portion of the first sustain electrode 12A and the top end portion of the second sustain electrode 12B have corners removed or are rounded. That is, as shown in FIG. 16, preferably, the top end portion of the first sustain electrode 12A and the top end portion of the second sustain electrode 12B have corners removed or are rounded.

Further, for preventing abnormal discharge between the top end portion of the first sustain electrode 12A and the second bus electrode 13B or preventing abnormal discharge between the top end portion of the second sustain electrode 12B and the first bus electrode 13A, it is preferred to satisfy $L_1<L_2$ in which $L_1$ is a distance between the first sustain electrode 12A and the second sustain electrode 12B and $L_2$ is a distance between the first bus electrode 13A and the top end portion of the second sustain electrode 12B or a distance between the second bus electrode 13B and the top end portion of the first sustain electrode 12A. Specifically, for example, $L_1=5\times10^{-5}$ m (50 $\mu$m) and $L_2=8\times10^{-5}$ m (80 $\mu$m).

In the constitution shown in FIG. 15 or 16, the first sustain electrode 12A and the second sustain electrode 12B are placed side by side and extend, in parallel with the second direction, from the bus electrodes 13A and 13B. Each pixel has a generally square form, each pixel is divided into three sections (cells) with the separation walls, and each section emits light in one color of three primary colors (R, G, B). When the outer dimension of one pixel is $L_0$, the dimension of each section is slightly smaller than $(L_0/3)\times L_0$. In a pair of the sustain electrodes 12A and 12B, therefore, the length of portions of the sustain electrodes 12A and 12B which portion contribute to glow discharge is close to the value of $(L_0)$. That is, those portions which contribute to glow discharge can be approximately three times as long as the counterparts in the plasma display devices shown in FIGS. 6 to 12, and as a result, a discharge region can be broadened. The plasma display device can be therefore far more improved in brightness. In the above constitution, the area of the sustain electrode can be decreased, and as a result, the electrode capacitance can be decreased, so that the power consumption can be decreased.

Figure 18:
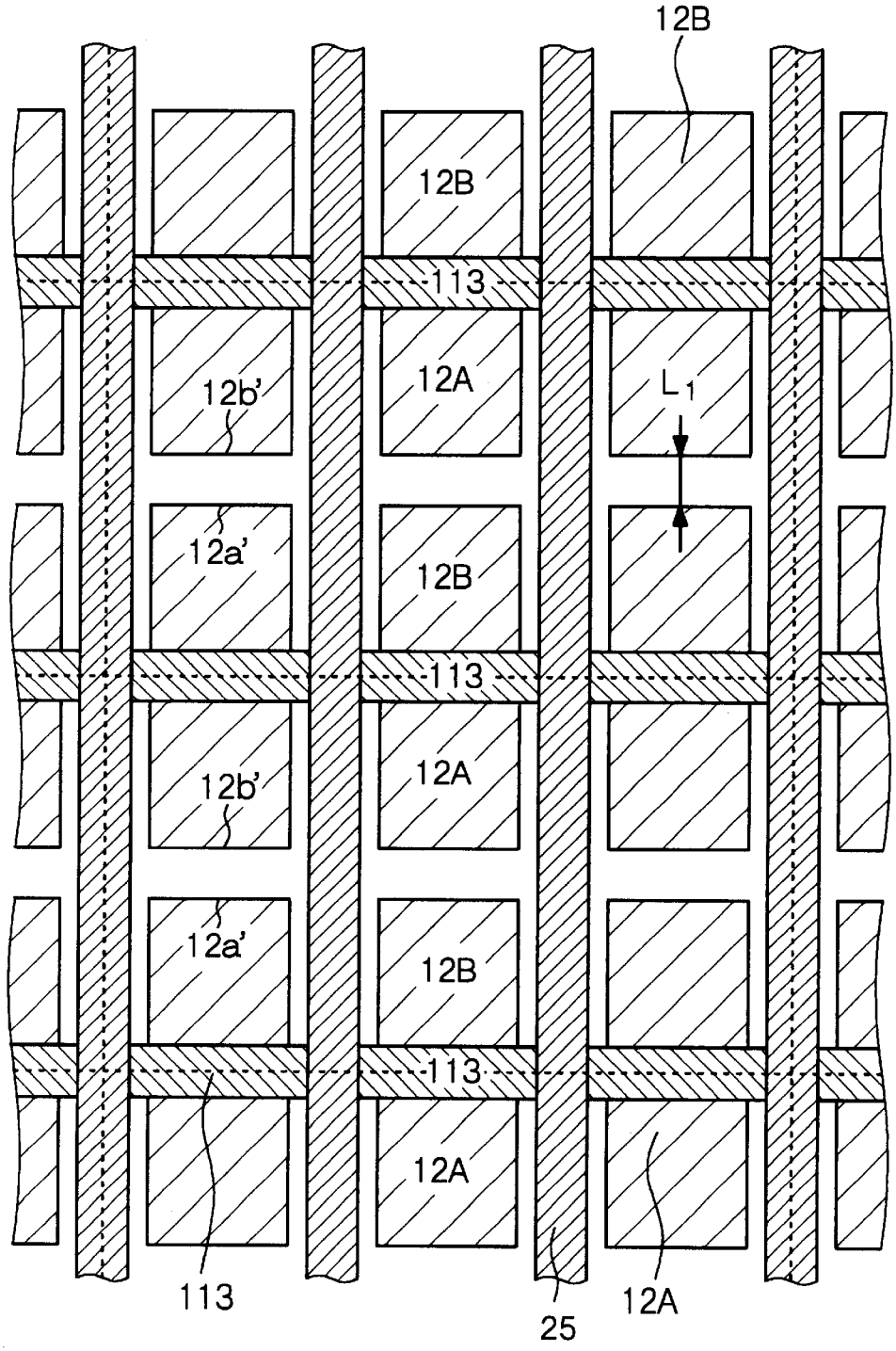
FIG. 18 is a schematic layout of sustain electrodes, bus electrodes and separation walls when the sustain electrodes shown in FIG. 14 are combined with the bus electrodes explained in Example.
Figure 19:
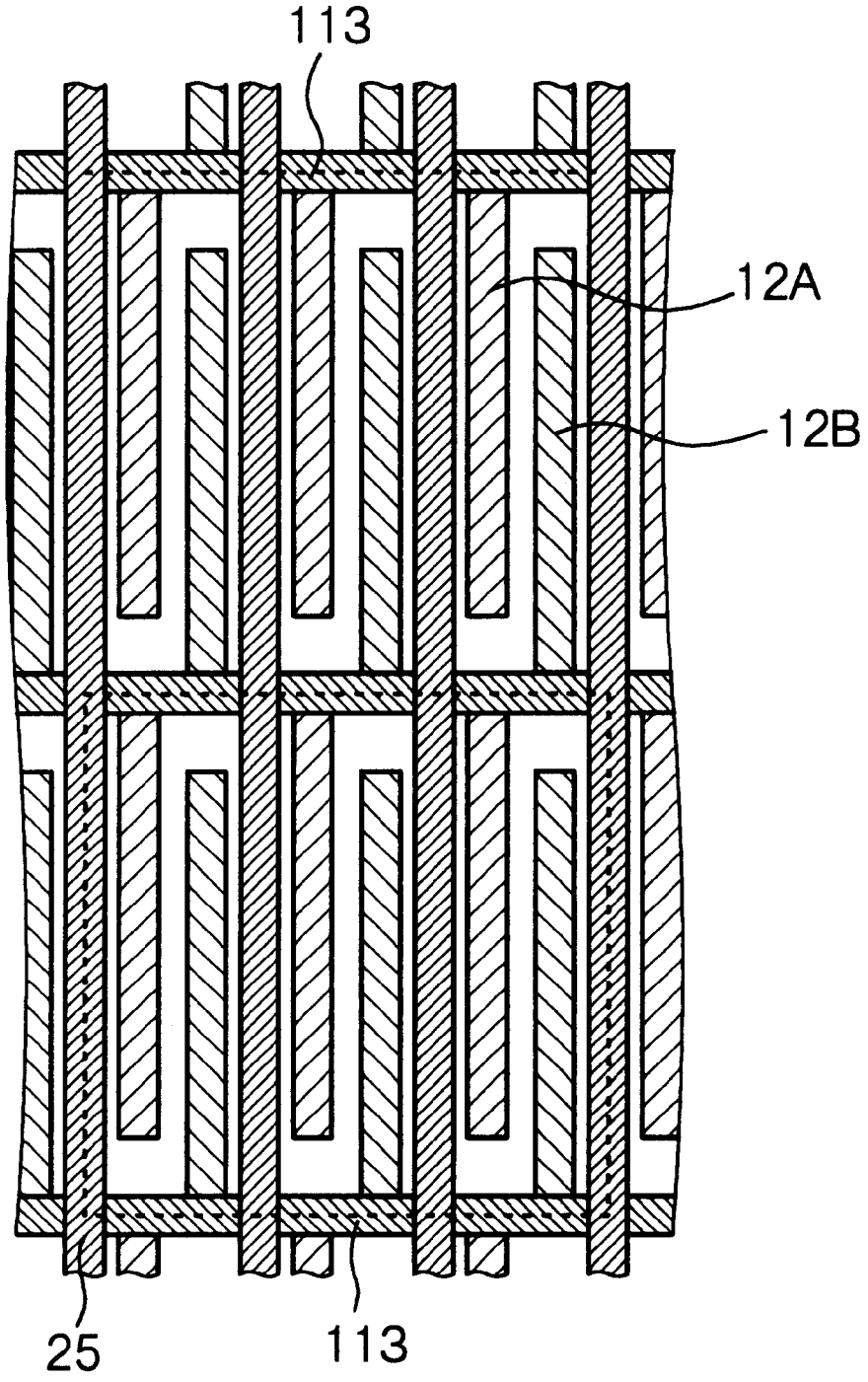
FIG. 19 is a schematic layout of sustain electrodes, bus electrodes and separation walls when the sustain electrodes shown in FIG. 15 are combined with the bus electrodes explained in Example.
Figure 20:
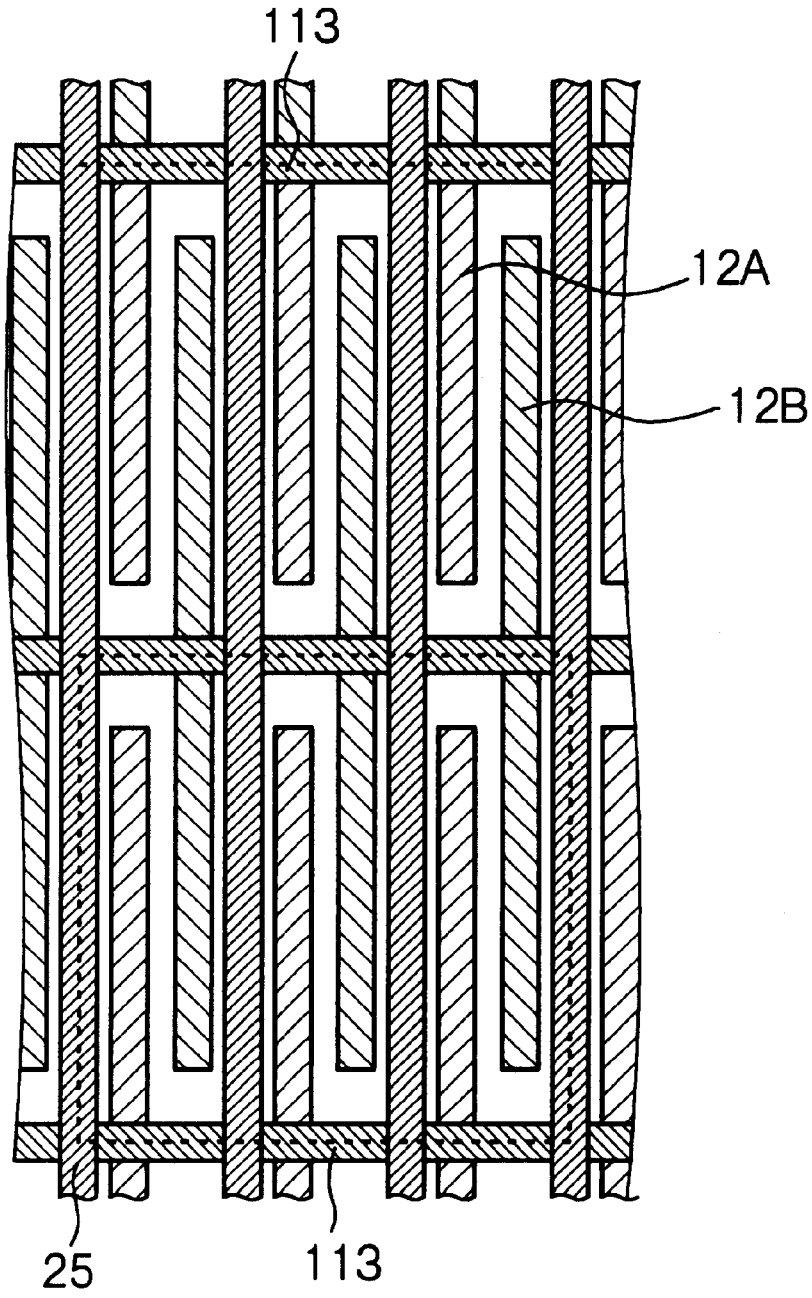
FIG. 20 is a variant of the schematic layout of sustain electrodes, bus electrodes and separation walls when the sustain electrodes shown in FIG. 15 are combined with the bus electrodes explained in Example 10.
Figure 21A:
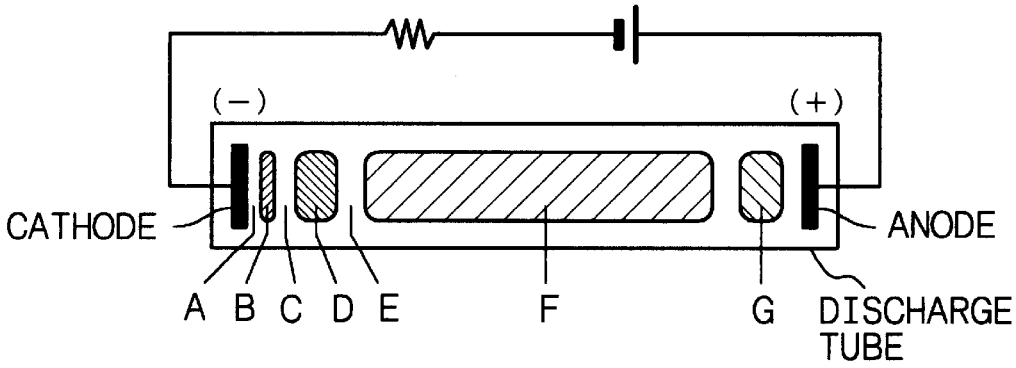
FIGS. 21A and 21B are schematic drawings of light-emission states of glow discharge in a discharge cell.
Figure 21B:
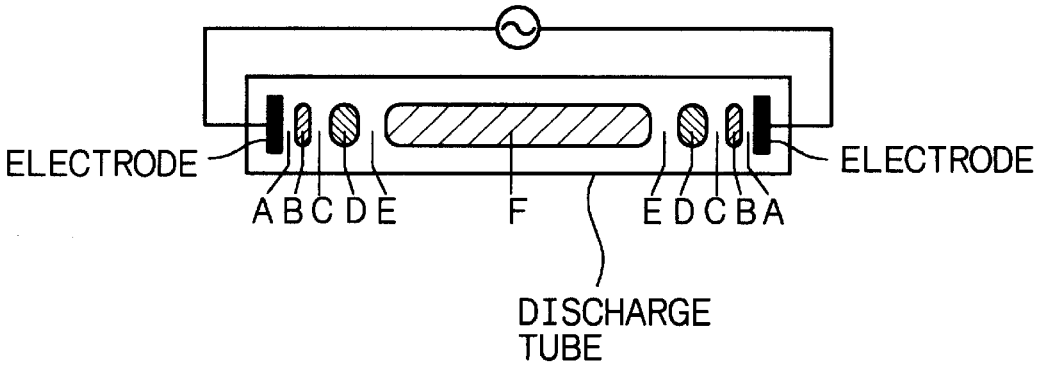
Figure 22A:
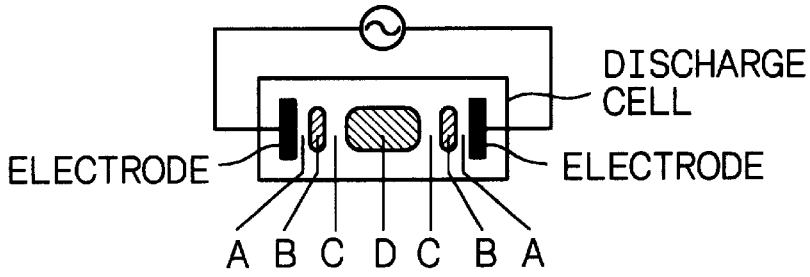
FIGS. 22A and 22B are schematic drawings of light-emission states of glow discharge in a discharge cell.
Figure 22B:
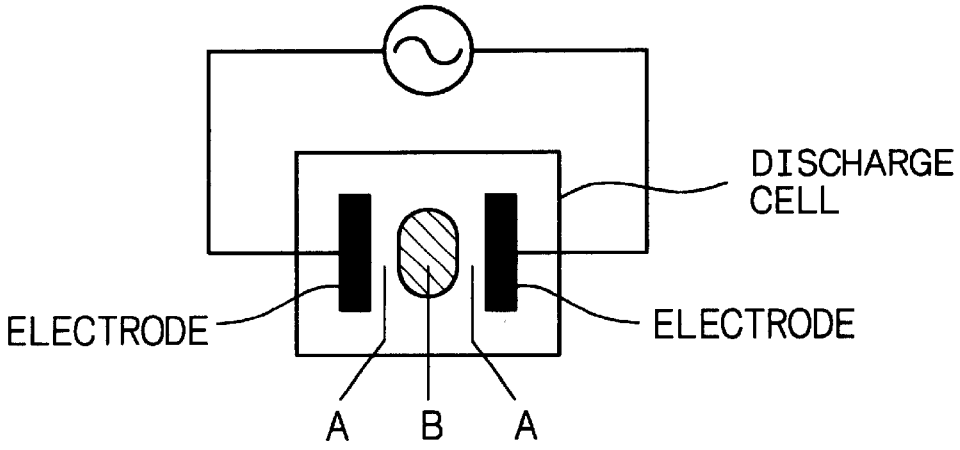
Figure 23:
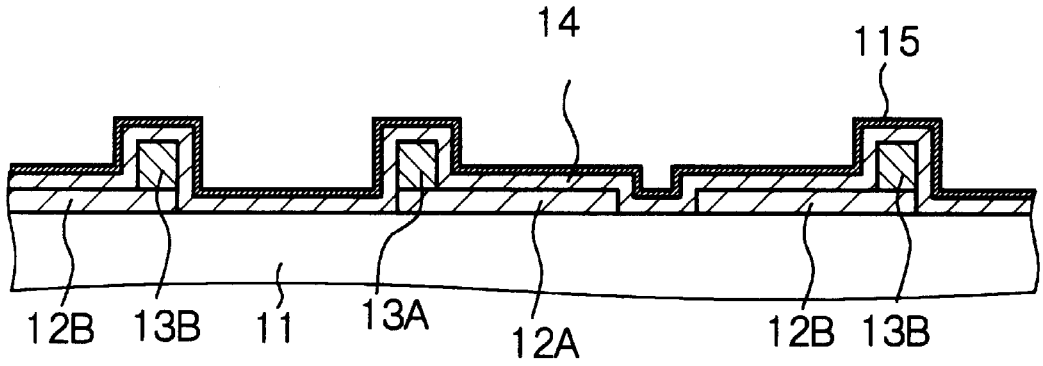
Fig. 23 (PRIOR ART)
FIG. 23 is a schematic partial end view of a first panel taken by cutting the first panel similarly along arrows B—B in FIG. 6 in a conventional plasma display device.

The dielectric material layer explained in any one of Examples 1 to 10 can be applied to the embodiments shown in FIGS. 14 to 16. The constitution of the common bus electrode explained in Example 10 can be applied to the embodiments shown in FIGS. 14 to 16. FIG. 18 schematically shows a layout of the sustain electrodes 12A and 12B, the common bus electrode 113 and the separation walls 25 when the sustain electrodes shown in FIG. 14 are combined with the common bus electrode 113 explained in Example 10. FIGS. 19 and 20 schematically show layouts of the sustain electrodes 12A and 12B, the common bus electrode 113 and the separation walls 25 when the sustain electrodes shown in FIG. 15 are combined with the common bus electrode 113 explained in Example 10.

Alternatively, in the embodiments shown in FIGS. 14 to 20, the second dielectric material layer 14B can be formed in regions of the first panel 10 which regions correspond to the separation walls 25 formed in the second panel 20. That is, the second dielectric material layer 14B can be formed in the form of a grille (lattice) as a plan form. In this case, specifically, the first electrode (more specifically, the bus electrodes 13A and 13B and the common bus electrode 113), the second dielectric material layer 14B and the first dielectric material layer 14A are formed in this order and formed in the region of the first panel 10 which region corresponds to the separation wall 25 formed in the second panel 20. Otherwise, the first electrode (more specifically, the bus electrodes 13A and 13B and the common bus electrode 113), the first dielectric material layer 14A and the second bus electrode 14B are formed in this order and formed in the region of the first panel 10 which region corresponds to the separation wall 25 formed in the second panel 20. The above structure can reliably prevent a so-called optical crosstalk in which glow discharge has an influence on a neighboring discharge cell.

In a plasma display device according to any one of the first to seventh aspects of the present invention, the dielectric material layer has a sufficiently small thickness as compared with any conventional AC plasma display device, or the dielectric material layer is composed of a material having a high specific dielectric constant, so that the capacitance of the dielectric material layer can be increased. As a result, since the charge accumulation amount can be increased, the driving power, i.e., the power consumption can be decreased, and further the plasma display device can be improved in brightness. Further, the aluminum oxide layer, the diamond-like carbon layer, the boron nitride layer and the chromium (III) oxide layer have a high layer density, cause almost no abnormal discharge and have improved discharge stability, so that the plasma display device comes to be highly reliable. When the stacked structure including a silicon oxide layer, etc., is used, the stress in the dielectric material layer can be eased, and the cracking of the dielectric material layer can be prevented.

In the plasma display device according to any one of the first to seventh aspects of the present invention, when the distance between a pair of the sustain electrodes is less than $5\times10^{-5}$ m, preferably less than $5.0\times10^{-5}$ m, more preferably $2\times10^{-5}$ m or less, the driving power can be decreased as compared with any conventional plasma display device in which the distance between a pair of the sustain electrodes is approximately 100 $\mu$m. Therefore, not only a load on the driving circuit of the plasma display device can be decreased, but also the stability in discharge is improved. Further, when the driving power is equal to, or close to, the driving power of a conventional plasma display device, the plasma display device of the present invention is improved in light-emission brightness. Further, a higher fineness and a higher-density display can be achieved, or the brightness can be improved with an increase in the area of the fluorescence layers.

In the plasma display device according to the eighth aspect of the present invention, since the first portion of the dielectric material layer which portion covers the first bus electrode and the second bus electrode comprises the first dielectric material layer and the second dielectric material layer, abnormal discharge, for example, between the edge portion of top surface of the bus electrode and the second electrode can be reliably prevented. Further, since the first dielectric material layer covering the first sustain electrode and the second sustain electrode can be decreased in thickness, the distance (discharge gap) between a pair of the sustain electrodes can be decreased. As result, a higher density in pixels and driving at a low voltage can be attained. The light transmissivity increases, so that the light emission efficiency is improved and that a screen having a higher brightness can be realized.

In the plasma display device according to the eighth aspect of the present invention, since the first portion of the dielectric material layer which portion covers the first bus electrode and the second bus electrode comprises the first dielectric material layer and the second dielectric material layer, broadening of a discharge region to discharge cells neighboring along the second direction can be prevented, and an optical crosstalk between the discharge cells neighboring on each other along the second direction and the deterioration of the brightness distribution among pixels can be prevented, which results in stable operation and an improvement in image quality. Further, since the first bus electrode and the second bus electrode are covered with the second dielectric material layer having a relatively large thickness, the electrode capacitance decreases and the power consumption can be decreased.

In the plasma display device according to the eighth aspect of the present invention, when the first dielectric material layer and the second dielectric material layer are formed on the first substrate between the first bus electrode constituting the first electrode and the second bus electrode constituting the first electrodes neighboring on the above first electrode, abnormal discharge between these bus electrodes can be reliably prevented.

In the plasma display device according to the eighth aspect of the present invention, there may be employed a constitution in which the first sustain electrode extends from the first bus electrode toward the second bus electrode but short of the second bus electrode, the second sustain electrode extends from the second bus electrode toward the first bus electrode but short of the first bus electrode while being positioned side by side with the first sustain electrode, and when glow discharge takes place between the first sustain electrode portion facing the second sustain electrode and the second sustain electrode portion facing the first sustain electrode, the portions of the sustain electrodes which contribute to the glow discharge have sufficiently large lengths. As a result, the discharge regions can be broadened, and the plasma display device can be improved in brightness in spite of its simple constitution.

What is claimed is:

1. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a thickness of 1.5×10–5 m or less, wherein the sustain electrodes formed in the first panel are constituted to work as a pair, and the distance between the sustain electrodes constituting each pair is less than 5×10–5 m.

2. The plasma display device according to claim 1, wherein the distance between the sustain electrodes constituting each pair is 2×10–5 m or less.

3. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of an aluminum oxide layer, wherein the sustain electrodes formed in the first panel are constituted to work as a pair, and the distance between the sustain electrodes constituting each pair is less than 5×10–5 m.

4. The plasma display device according to claim 3, wherein the dielectric material layer has a thickness of $1.5\times10^{-5}$ m or less.

5. The plasma display device according to claim 4, wherein the dielectric material layer has a thickness of $1.0\times10^{-5}$ m or less.

6. The plasma display device according to claim 3, wherein the distance between the sustain electrodes constituting each pair is 2×10–5 m or less.

7. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a stacked structure constituted, at least, of an aluminum oxide layer and a silicon oxide layer, wherein the sustain electrodes formed in the first panel are constituted to work as a pair, and the distance between the sustain electrodes constituting each pair is less than 5×10–5 m.

8. The plasma display device according to claim 7, wherein the dielectric material layer has a thickness of $1.5\times10^{-5}$ m or less.

9. The plasma display device according to claim 8, wherein the dielectric material layer has a thickness of $1.0\times10^{-5}$ m or less.

10. The plasma display device according to claim 7, wherein the distance between the sustain electrodes constituting each pair is 2×10–5 m or less.

11. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of a silicon oxide layer, wherein the sustain electrodes formed in the first panel are constituted to work as a pair, and the distance between the sustain electrodes constituting each pair is less than 5×10–5 m.

12. The plasma display device according to claim 11, wherein the dielectric material layer has a thickness of $1.5\times10^{-5}$ m or less.

13. The plasma display device according to claim 12, wherein the dielectric material layer has a thickness of $1.0\times10^{-5}$ m or less.

14. The plasma display device according to claim 11, wherein the distance between the sustain electrodes constituting each pair is 2×10–5 m or less.

15. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of a diamond-like carbon layer, a boron nitride layer or a chromium (III) oxide layer, wherein the sustain electrodes formed in the first panel are constituted to work as a pair, and the distance between the sustain electrodes constituting each pair is less than 5×10–5 m.

16. The plasma display device according to claim 15, wherein the dielectric material layer has a thickness of $1.5\times10^{-5}$ m or less.

17. The plasma display device according to claim 16, wherein the dielectric material layer has a thickness of $1.0\times10^{-5}$ m or less.

18. The plasma display device according to claim 15, wherein the distance between the sustain electrodes constituting each pair is 2×10–5 m or less.

19. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer has a stacked structure constituted, at least, a layer composed of diamond-like carbon, boron nitride or chromium (III) oxide and a layer composed of silicon oxide or aluminum oxide, wherein the sustain electrodes formed in the first panel are constituted to work as a pair, and the distance between the sustain electrodes constituting each pair is less than 5×10–5 m.

20. The plasma display device according to claim 19, wherein the dielectric material layer has a thickness of $1.5\times10^{-5}$ m or less.

21. The plasma display device according to claim 20, wherein the dielectric material layer has a thickness of $1.0\times10^{-5}$ m or less.

22. The plasma display device according claim 19, wherein the distance between the sustain electrodes constituting each pair is 2×10–5 m or less.

23. An alternating current driven type plasma display device comprising a first panel and a second panel, said first panel having sustain electrodes formed on a first substrate and a dielectric material layer formed on the first substrate and the sustain electrodes, wherein the first panel and the second panel are bonded to each other in their circumferential portions, characterized in that the dielectric material layer is constituted, at least, of two layers selected from the group consisting of a diamond-like carbon layer, a boron nitride layer and a chromium (III) oxide layer.

24. The plasma display device according to claim 23, wherein the dielectric material layer has a thickness of $1.5\times10^{-5}$ m or less.

25. The plasma display device according to claim 24, wherein the dielectric material layer has a thickness of $1.0\times10^{-5}$ m or less.

26. The plasma display device according to claim 23, wherein the sustain electrodes formed in the first panel are constituted to work as a pair, and the distance between the sustain electrodes constituting each pair is less than 5×10–5 m.

27. The plasma display device according to claim 26, wherein the distance between the sustain electrodes constituting each pair is $2\times10^{-5}$ m or less.

28. The plasma display device according to claim 23, wherein the dielectric material layer further has a silicon oxide layer or an aluminum oxide layer or further has a stacked structure of a silicon oxide layer and an aluminum oxide layer.

29. The plasma display device according to claim 28, wherein the dielectric material layer has a thickness of $1.5\times10^{-5}$ m or less.

30. The plasma display device according to claim 29, wherein the dielectric material layer has a thickness of $1.0\times10^{-5}$ m or less.

31. The plasma display device according to claim 28, wherein the sustain electrodes formed in the first panel are constituted to work as a pair, and the distance between the sustain electrodes constituting each pair is less than 5×10–5 m.

32. The plasma display device according to claim 31, wherein the distance between the sustain electrodes constituting each pair is $2\times10^{-5}$ m or less.

33. An alternating current driven type plasma display device comprising;

(1) a first panel having a first substrate; a first electrode group consisting of a plurality of first electrodes formed on the first substrate; and a dielectric material layer which covers the first electrodes and is constituted of a first dielectric material layer and a second dielectric material layer, and (2) a second panel having a second substrate; a second electrode group consisting of a plurality of second electrodes extending while making a predetermined angle with the extending direction of the first electrodes, said second electrodes being formed on the second substrate; separation walls each of which is formed between one second electrode and another neighboring second electrode; and fluorescence layers formed on or above the second electrodes, wherein each first electrode comprises;

(A) a first bus electrode, (B) a first sustain electrode being in contact with the first bus electrode, (C) a second bus electrode extending in parallel with the first bus electrode, and (D) a second sustain electrode being in contact with the second bus electrode and facing the first sustain electrode, and wherein discharge takes place between the first sustain electrode and the second sustain electrode, said plasma display device characterized in that a first portion of the dielectric material layer which portion covers the first bus electrode and the second bus electrode comprises the first dielectric material layer and the second dielectric material layer, and a second portion of the dielectric material layer which covers the first sustain electrode and the second sustain electrode comprises the first dielectric material layer.

34. The plasma display device according to claim 33, wherein the second portion of the dielectric material layer which portion covers the first and second sustain electrodes has a thickness of $1\times10^{-5}$ m or less.

35. The plasma display device according to claim 34, wherein the first sustain electrode extends in parallel with the first bus electrode and the second sustain electrode extends in parallel with the second bus electrode.

36. The plasma display device according to claim 34, wherein the first sustain electrode and the second sustain electrode are formed between a pair of separation walls.

37. The plasma display device according to claim 36, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

38. The plasma display device according to claim 36, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

39. The plasma display device according to claim 33, wherein the first dielectric material layer and the second dielectric material layer are formed on the first substrate between the first bus electrode constituting the first electrode and the second bus electrode constituting the first electrode neighboring on said first electrode.

40. The plasma display device according to claim 33, wherein the second dielectric material layer is further formed on or above a region of the first panel which region corresponds to the separation wall formed in the second panel.

41. The plasma display device according to claim 33, wherein the material constituting the first dielectric material layer differs from the material constituting the second dielectric material layer.

42. The plasma display device according to claim 41, wherein the second portion of the dielectric material layer which portion covers the first and second sustain electrodes has a thickness of $1\times10^{-5}$ m or less.

43. The plasma display device according to claim 42, wherein the first dielectric material layer is composed of silicon oxide and the second dielectric material layer is composed of a calcined product of a glass paste.

44. The plasma display device according to claim 41, wherein the first dielectric material layer is composed of silicon oxide and the second dielectric material layer is composed of a calcined product of a glass paste.

45. The plasma display device according to claim 41, wherein the first sustain electrode extends in parallel with the first bus electrode and the second sustain electrode extends in parallel with the second bus electrode.

46. The plasma display device according to claim 41, wherein the first sustain electrode and the second sustain electrode are formed between a pair of separation walls.

47. The plasma display device according to claim 46, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

48. The plasma display device according to claim 46, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

49. The plasma display device according to claim 33, wherein the first sustain electrode extends in parallel with the first bus electrode and the second sustain electrode extends in parallel with the second bus electrode.

50. The plasma display device according to claim 33, wherein the first sustain electrode and the second sustain electrode are formed between a pair of separation walls.

51. The plasma display device according to claim 50, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

52. The plasma display device according to claim 50, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

53. The plasma display device according to claim 33, wherein a first bus electrode constituting a first electrode and a second bus electrode constituting a first electrode neighboring on said first electrode are in common.

54. The plasma display device according to claim 53, wherein the second portion of the dielectric material layer which portion covers the first and second sustain electrodes has a thickness of $1\times10^{-5}$ m or less.

55. The plasma display device according to claim 54, wherein the first sustain electrode extends in parallel with the first bus electrode and the second sustain electrode extends in parallel with the second bus electrode.

56. The plasma display device according to claim 54, wherein the first sustain electrode and the second sustain electrode are formed between a pair of separation walls.

57. The plasma display device according to claim 56, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

58. The plasma display device according to claim 56, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

59. The plasma display device according to claim 53, wherein the second dielectric material layer is further formed on or above a region of the first panel which region corresponds to the separation wall formed in the second panel.

60. The plasma display device according to claim 53, wherein the material constituting the first dielectric material layer differs from the material constituting the second dielectric material layer.

61. The plasma display device according to claim 60, wherein the second portion of the dielectric material layer which portion covers the first and second sustain electrodes has a thickness of $1\times10^{-5}$ m or less.

62. The plasma display device according to claim 61, wherein the first dielectric material layer is composed of silicon oxide and the second dielectric material layer is composed of a calcined product of a glass paste.

63. The plasma display device according to claim 60, wherein the first dielectric material layer is composed of silicon oxide and the second dielectric material layer is composed of a calcined product of a glass paste.

64. The plasma display device according to claim 60, wherein the first sustain electrode extends in parallel with the first bus electrode and the second sustain electrode extends in parallel with the second bus electrode.

65. The plasma display device according to claim 60, wherein the first sustain electrode and the second sustain electrode are formed between a pair of separation walls.

66. The plasma display device according to claim 65, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

67. The plasma display device according to claim 65, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

68. The plasma display device according to claim 53, wherein the first sustain electrode extends in parallel with the first bus electrode and the second sustain electrode extends in parallel with the second bus electrode.

69. The plasma display device according to claim 53, wherein the first sustain electrode and the second sustain electrode are formed between a pair of separation walls.

70. The plasma display device according to claim 69, wherein the first sustain electrode extends from the first bus electrode toward the second bus electrode, the second sustain electrode extends from the second bus electrode toward the first bus electrode, and discharge takes place between a top end portion of the first sustain electrode and a top end portion of the second sustain electrode.

71. The plasma display device according to claim 69, wherein the first sustain electrode extends from the first bus electrode toward the second bus electrode and extends short of the second bus electrode, the second sustain electrode extends from the second bus electrode toward the first bus electrode and extends short of the first bus electrode so as to face the first sustain electrode, and discharge takes place between a portion of the first sustain electrode which portion faces the second sustain electrode and a portion of the second sustain electrode which portion faces the first sustain electrode.

* * * * *